US009206950B1

(12) United States Patent
Lemons et al.

(10) Patent No.: US 9,206,950 B1
(45) **Date of Patent: *Dec. 8, 2015**

(54) LIGHT EMITTING DIODE (LED) SPORTS LIGHTING LUMINAIRE ASSEMBLY

(71) Applicant: T&S Lighting Solutions, LLC, Salem, MA (US)

(72) Inventors: Thomas M. Lemons, Peabody, MA (US); Steven Rosen, Marblehead, MA (US); Cynthia Gernetzke, Beverly, MA (US); Bryan Lussier, Beverly, MA (US)

(73) Assignee: T&S Lighting Solutions, LLC, Salem, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/639,444

(22) Filed: Mar. 5, 2015

Related U.S. Application Data

(63) Continuation of application No. 14/305,943, filed on Jun. 16, 2014, now Pat. No. 8,998,449.

(51) Int. Cl.

| | |
|---|---|
| ***F21S 4/00*** | (2006.01) |
| ***F21V 21/00*** | (2006.01) |
| ***F21K 99/00*** | (2010.01) |
| ***F21S 2/00*** | (2006.01) |
| ***F21V 19/02*** | (2006.01) |
| *F21Y 101/02* | (2006.01) |
| *F21W 131/105* | (2006.01) |

(52) U.S. Cl.
CPC . *F21K 9/50* (2013.01); *F21S 2/005* (2013.01); *F21V 19/02* (2013.01); *F21W 2131/105* (2013.01); *F21Y 2101/02* (2013.01)

(58) Field of Classification Search
CPC ..... F21K 9/00; F21K 9/58; F21Y 2101/02
USPC ..... 362/249.02–249.03, 311.02, 800
See application file for complete search history.

(56) References Cited

U.S. PATENT DOCUMENTS

| | | | |
|---|---|---|---|
| 3,940,606 | A | 2/1976 | Lemons |
| 3,950,638 | A | 4/1976 | Kent et al. |
| RE31,003 | E | 7/1982 | Lemons |
| 4,536,832 | A | 8/1985 | Lemons |
| 4,569,003 | A | 2/1986 | Elmer et al. |
| 4,668,869 | A | 5/1987 | Matosian et al. |
| 4,864,476 | A | 9/1989 | Lemons et al. |
| 5,036,436 | A | 7/1991 | Rattigan et al. |

(Continued)

FOREIGN PATENT DOCUMENTS

| | | | |
|---|---|---|---|
| WO | WO2012044824 | A2 | 4/2012 |
| WO | WO2013090536 | A1 | 6/2013 |

OTHER PUBLICATIONS

PCT/US2015/018949 International Search Report, Mar. 5, 2015, T&S Lighting Solutions, LLC.

(Continued)

*Primary Examiner* — Jason Moon Han
(74) *Attorney, Agent, or Firm* — AGG Intellectual Property Law; Antoinette G. Giugliano

(57) ABSTRACT

An assembly of LED luminaires is distributed at a sports venue, includes key, back, and fill light sources in such a way as to provide modeling within a significant portion of the playing area of the sports venue, uses beam types narrower than previously used, and achieves efficiencies higher than previously attained, while also reducing glare and spill light.

22 Claims, 22 Drawing Sheets

(A) (B)

(56) References Cited

U.S. PATENT DOCUMENTS

| | | | |
|---|---|---|---|
| 5,313,379 | A | 5/1994 | Lemons et al. |
| 5,390,095 | A | 2/1995 | Lemons et al. |
| 5,485,319 | A | 1/1996 | Lemons |
| 5,519,590 | A | 5/1996 | Crookham et al. |
| 5,622,427 | A | 4/1997 | Lemons et al. |
| 5,730,521 | A | 3/1998 | Spink et al. |
| 5,865,527 | A | 2/1999 | Lemons et al. |
| 6,177,678 | B1 | 1/2001 | Brass et al. |
| 6,502,963 | B1 | 1/2003 | King |
| 6,703,799 | B2 | 3/2004 | Summerford et al. |
| 6,832,846 | B2 | 12/2004 | Lagonegro |
| RE38,767 | E | 8/2005 | Wedell et al. |
| 6,979,104 | B2 | 12/2005 | Brass et al. |
| 7,204,606 | B2 | 4/2007 | Brass et al. |
| 7,246,918 | B2 | 7/2007 | Ginsburg |
| D583,500 | S | 12/2008 | Gordin |
| 7,540,629 | B2 | 6/2009 | Steinberg |
| 7,568,816 | B2 | 8/2009 | Brass et al. |
| 7,789,540 | B2 | 9/2010 | Gordin et al. |
| 7,863,829 | B2 | 1/2011 | Sayers et al. |
| 7,963,681 | B2 | 6/2011 | Hammel |
| 7,988,327 | B1 | 8/2011 | Knoble et al. |
| 8,162,511 | B1 | 4/2012 | Gordin et al. |
| 8,300,219 | B1 | 10/2012 | Gordin et al. |
| 8,356,916 | B2 | 1/2013 | Gordin et al. |
| 8,490,267 | B2 | 7/2013 | Stone |
| 8,523,397 | B1 | 9/2013 | Gordin |
| 8,585,253 | B2 | 11/2013 | Duong et al. |
| 8,602,588 | B2 | 12/2013 | Gordin et al. |
| 8,672,509 | B2 | 3/2014 | Gordin et al. |
| 8,717,552 | B1 | 5/2014 | Gordin et al. |
| 8,998,449 | B1 | 4/2015 | Lemons et al. |
| 2004/0220001 | A1 | 11/2004 | Oister et al. |
| 2008/0266870 | A1 | 10/2008 | Gordin |
| 2009/0135596 | A1 | 5/2009 | Gordin |
| 2009/0197710 | A1 | 8/2009 | Ronda |
| 2011/0013401 | A1 | 1/2011 | Gordin et al. |
| 2012/0281399 | A1 | 11/2012 | Crookham et al. |
| 2012/0294037 | A1 | 11/2012 | Holman et al. |
| 2013/0077304 | A1 | 3/2013 | Gordin et al. |
| 2013/0094206 | A1 | 4/2013 | Gordin |
| 2013/0268246 | A1 | 10/2013 | Gordin |

OTHER PUBLICATIONS

Lemons, T. M., *Current Sources for Stadium Lighting, LD+A* (Feb. 1973).

Lemons, T. M., *Optimizing Outdoor Recreational Lighting Design, LD+A* (Apr. 1974).

Lemons, T. M. & Spink, K., *Outdoor Sports Lighting Luminaire Positions*, Presented at IES Conference (Jul. 30-Aug. 2, 1995).

Lemons, T.M., *Modelling for Sports Lighting*, CIE Publication # X017, Vienna, Austria (2000).

Lemons, T. M., *Sports Luminaire Performance & MH Lamp Tilt Factor*, Presented at IES Conference (Nov. 2008).

Lemons, T. M. & Houser, K. W., *Sports Lighting Installation Designs*, Presented at IES Conference (Nov. 2010).

Recommended Practice for Sports and Recreational Area Lighting; IESNA RP-6-01 (Reaffirmed 2008).

DiLaura, D.L. et al., The Lighting Handbook, $10^{th}$ Ed., Illuminating Engineering Society of America, Chapter 35 (2011).

National Electrical Manufacturers' Association, 2101 L Street, NW, Washington DC, Publication FA1—pp. 12-3 (1973).

ILV: International Lighting Vocabulary (Abstract and selected definitions—Downloaded from http://cie.co.at/index.php?i_ca_id=827 on Jul. 22, 2014).

| OUTDOOR FLOODLIGHT LUMINAIRE DESIGNATIONS | | | | | | | |
|---|---|---|---|---|---|---|---|
| Beam Spread Degrees | NEMA Type | Minimum Efficiencies (per cent) | | | | | |
| | | Incandescent Lamps | | Mercury Lamps | | Fluorescent Lamps | Low Pressure Sodium Lamps |
| | | Effective Reflector Area (square inches) | | | | | |
| | | Under 227 | Over 227 | Under 227 | Over 227 | Any | Any |
| 10 up to 18 | 1 | 34 | 35 | .. | .. | 20 | |
| 18 up to 29 | 2 | 36 | 36 | 22 | 30 | 25 | |
| 29 up to 46 | 3 | 39 | 45 | 24 | 34 | 35 | |
| 46 up to 70 | 4 | 42 | 50 | 35 | 38 | 42 | |
| 70 up to 100 | 5 | 46 | 50 | 38 | 42 | 50 | |
| 100 up to 130 | 6 | .. | .. | 42 | 46 | 55 | 58 |
| 130 and up | 7 | .. | .. | 46 | 50 | 55 | 67 |

-- Prior Art --

Fig. 1

LIGHT EMITTING DIODE (LED) SPORTS LIGHTING LUMINAIRE ASSEMBLY

RELATED APPLICATION

This application is a continuation of U.S. application Ser. No. 14/305,943, entitled, "Light Emitting Diode (LED) Sports Lighting Luminaire Assembly" by Thomas M. Lemons et al., filed Jun. 16, 2014.

The entire teachings of the above application are incorporated herein by reference.

BACKGROUND OF THE INVENTION

Lighting of sports venues such as football fields, soccer fields, baseball fields, and tennis courts is challenging. Visibility is just one initial basic concern. Other concerns such as attainment of a specific level of illumination; distribution of light; uniformity of illuminance in different areas of the playing area; cost of lighting installations; life-cycle costs of lamps; luminaire efficiencies; beam patterns of the delivered illumination; effects of light trespass or spill light (e.g., light on neighboring areas); human perception of opposing players; revealing the spin of a ball and its path of travel; glare; and many other aspects of lighting all need to be considered.

Previously, the 1964/65 introduction of the metal halide lamp made the 1000 watt version a natural replacement for the 1500 watt incandescent lamp which had been the lamp of choice for sports lighting in the 1970's. By the 1980's, a 1500 watt metal halide lamp was introduced and it is now the most common lamp used for the illumination of sports facilities in North America. The National Electrical Manufacturer's Association (NEMA) published an Outdoor Floodlight Luminaire Designation document FA1-1973. This document lists the information about floodlight luminaire beams based on a series of "beam spreads", "reflector effective area" and "minimum efficiencies" designated as a NEMA Types 1 through 7 (FIG. 1). This initial listing included information for floodlights using incandescent, mercury, fluorescent, and low pressure sodium lamps which were available in 1973. These beam type designations were adopted by the Illumination Engineering Society of North America (IESNA) (120 Wall Street, New York, N.Y. 10005), Sports Lighting Committee to identify which incandescent floodlights should be used for various sports lighting installations through the 1970's. With the introduction of the metal halide lamp in 1964/65, the NEMA Beam Type designation was also applied to metal halide floodlights but the efficiency designation was no longer used since metal halide luminaire beams were often not circular as was the case with the 1500 watt incandescent luminaire beams previously used in sports lighting.

While the currently used metal halide lamps and their utilized assemblies constitute an improvement over the relatively older incandescent lamps and assemblies thereof, they still suffer from various drawbacks. For example, the efficiency (amount of light delivered vs. amount of light produced of an installed family of metal halide lamps at a sports venue remains below 50%. In addition, a substantial portion of the playing area is not well modeled (e.g., depth perception is impaired, features of players and balls are obscured, and shapes and textures in general are not clear or easily discerned by the players) with the currently available installations. Currently known installations at sports venues also generate significant amount of spill light and glare. Many of these deficiencies create a need for a better system of lighting sports venues, from the amateur level all the way up to professional level.

SUMMARY OF THE INVENTION

In an embodiment, the present invention provides an assembly of luminaires for lighting a sports venue in which an area from 60% up to 100% of the playing area can be modeled using arrays of LED light sources formed by a number of LED light sources distributed around the sports venue and directed at the playing area. The arrays of LED light sources (e.g., an array containing 2, 10, 20, 50, 100, 200 LED light sources) are contained in luminaires that produce key light, back light, or fill light directed at specific locations of the playing area. In some embodiments, the back light is optional (e.g., modeling can still be obtained by key light from one direction and fill light from two directions). The luminous flux of key and back light is of a similar value. The luminous flux of fill light is at most about 60% (e.g., 40%, 50%, 60%) of the luminous flux of the key or back light (if one of the two is being used) and also similarly at most about 40% (e.g., 20%, 30%, 40%) of the combined luminous flux when both key light and back light are being used. As an example, the fill light can be no more than about 40% of the sum of the key light and the back light. In addition to the LED light sources, the luminaires can also have a number of optics (e.g., reflectors, lenses), mounted relative to the arrays of LED light sources, which can control the light sources to produce beams of specific types (e.g., NEMA type 0, 1, 2, 3, 4, or 5). NEMA type 0 beam types are defined further herein but generally refer to a beam type with less than a 10 degree beam spread. This concept is being introduced with this document and has not been employed for sports lighting before. The luminaires can also include a number of mounts (e.g., poles) to position the light sources and the optics. In such embodiments, the assembly of luminaires of the present invention achieves a utilization factor (i.e., "utilance, lamp"; denoted as $U_l$) greater than 50%, while the distribution of key, fill, and optionally back lights provide modeling to the playing area. In alternative embodiments, the utilization factor can be 55% or more (e.g., 60%, 65%, 70%, 75%, 80%, 85%, and 90%). The modeled area of the playing area can be 60% to 100% (e.g., 60%, 65%, 70%, 75%, 80%, 85%, 90%, 95%, and 100%).

In other embodiments, the assembly of luminaires of the present invention has luminaires that are directed onto the playing area in directions that are perpendicular to the main playing axis of the players to limit glare for the players with the directions of luminaires deviating no more than a 40° from the perpendicular axis. In addition the luminaires are directed at each location in the playing area from three or four different directions. The luminaires can also be directed onto the playing area to limit glare from normal viewing direction of the spectators. The illumination that results from an installation of an assembly of luminaires can limit spill light and glare to meet industry established requirements for neighbors located around a sports venue. In various embodiments, reflection of light upward from the ground provides sufficient illumination for the players to see and follow fly balls, without needing to direct any of the luminaires above the horizontal plane of the luminaires, thereby also reducing sky glow. In certain embodiments, the luminaires include light sources that produce beams of NEMA type 0, which are defined herein to be beams with a beam spread of less than 10°. The NEMA type 0 beams can have efficiencies at 90%±4%, while the efficiencies of wider beams produced by the luminaires can still be greater than 80%. The sports venue to be illuminated by the assembly of LED luminaires can be any indoor or outdoor sports venue, such as a football field, soccer field, baseball field, hockey rink, basketball court, or tennis court. In the case of tennis courts, the assemblies can be distributed to simultaneously cover two or more tennis courts as opposed to only one.

In some embodiments of the present invention, all luminaires used are LED luminaires. Modeling can be created by using only key light and fill light, or alternatively by using key light, fill light, and back light.

In additional embodiments, the present invention relates to methods of illuminating a sports venue by an assembly of LED luminaires. In the methods, a number of LED luminaires can be positioned at the sport venue at locations appropriate to produce key light, back light, and fill light. At the LED luminaires, a number of optics can be mounted so as to produce LED luminaire beams of patterns such as those of NEMA types 0, 1, 2, 3, 4, or 5. Further, in the methods, an illumination can be distributed onto the sports venue so as to have key light and back light facing opposite directions and fill light being at an angle of 35° to 135° to the axis along the key and back light's beam axis. The luminous flux provided by the fill light can be 60% or less (e.g., 40%, 50%, 60%) of those provided by either of key light or back light, when only one of those is used. When both key light and back light are being used, the luminous flux provided by the fill light can be 40% or less (e.g., 20%, 30%, 40%) of the summed luminous flux of the key light and back light. It should be understood that the terms "key light" and "back light" are used relative to a viewing direction; therefore, if a certain viewing direction is changed into its opposite direction, the "back light" will now be the "key light", and the "key light" will be the "back light". Key light and back light, in any of the embodiments, can have luminous fluxes approximately between 80% and 100% (e.g., 90%, 100%) of each other.

The present invention involves an assembly of LED luminaires, in an embodiment, that includes NEMA type 0 narrow beams luminaires having high beam intensity and efficiency so as to provide light across the playing field and produce the desired key or back light over the whole playing area. In another embodiment, the assembly of LED luminaires of the present invention provides a high utilization factor that is over 55% (e.g., 60%, 65%, 70%, 75%, 80%, 85%, 90%, 95%), thereby reducing the energy required to illuminate a sports venue. In certain embodiments, the assembly of LED luminaries directs all of the luminaire beams onto the playing area and an immediate area adjacent to the playing area (e.g., an area that extends by less than 25% in each dimension of the playing area), thereby eliminating or significantly reducing the spill light at neighboring properties. In an embodiment, the assembly of LED luminaires provides modeling to at least 60% of the sports venue's playing area. The modeled area, in some embodiments, can be substantially the entire playing area.

There are many advantages conferred by the assembly of luminaires of the present invention. For example, because LED lights can be dimmed, a specific light level can be continuously obtained throughout the useful life of the lamps, which are estimated to provide 25 years of service. Using an LED light with a daylight color enables a smooth transition in a game that starts during natural daylight and ends later in the evening/night. The ability to switch an LED light on and off instantly enables sports venues to be lit only when in use. Using LEDs with luminous efficacies over 150 lumens per watt (lpw) can reduce the wattage, relative to that of a comparable metal halide lighting system, by about 50%, reaching a life cycle cost similar to that of a metal halide lighting system. Using LEDs with higher lpw values, such as 300 lpw, the life cycle cost of an LED used in the luminaire assembly of the present invention can be reduced by 25% to 40% as compared to the life cycle cost of a metal halide sports lighting luminaire family. Cost is also reduced during installation of the of the LED assemblies. The ability to use very narrow beams, for example those of NEMA type 0, enables not only illumination of distant portions of the playing area, but also crossing of luminaire aimings so that lights from different luminaires can blend (or meet from contrasting angles). Therefore, light from different luminaires can illuminate the same spot to create modeling. Using narrow beams also eliminates a potential need to increase pole heights, thereby decreasing spill light and glare. This is so, because narrow beams can be mounted at lower elevations than wide beams. The use of narrow beams, due to the ability to aim them near the opposite end of a playing field similarly contributes to a reduction in spill light. As an additional benefit, usage of LEDs results in an ability to obtain narrow beams with increased efficiency for the installations. For example, a NEMA type 0 beam (less than 10°) can have an efficiency of 80-90%, whereas wider beams would have efficiencies less than that. Older incandescent lamps did not produce NEMA type 0 beams, while the 1500 watt metal halide lamps similarly cannot produce NEMA types 0, 1, and 2. The increased efficiency combined with the increased intensity of narrow beams increases the percentage of the playing area that can be modeled. As a further demonstration of increased efficiency, the LED luminaire assemblies of the present invention also provide utilization factors that can exceed 50% (e.g., 55%, 60%, 65%, 70%, 75%, 80%, 85%, 90%, 95%), whereas the currently typical metal halide installations normally reach 30% to 40%. The disclosed configurations of LED luminaires further optimize the advantages detailed above and provide previously unattained efficiencies for energy usage, uniformities for separate parts of the playing area, and high percentages for the modeled area with respect to the playing area.

BRIEF DESCRIPTION OF THE DRAWINGS

The foregoing and other objects, features, and advantages of the invention will be apparent from the following more particular description of preferred embodiments of the invention, as illustrated in the accompanying drawings. The drawings are not necessarily to scale, emphasis instead being placed on illustrating the principles of the invention.

FIG. 1 is a table showing Outdoor Floodlight Luminaire Designations taken from National Electrical Manufacturers' Association, 2101 L Street, NW, Washington DC, Publication FA1-1973. Asymmetrical beam floodlights may be designated by a combination type designation which indicates the horizontal and vertical beam spreads in that order, e.g., a floodlight with a horizontal beam spread of 75 degrees (Type 5) and a vertical beam of 35 degrees (Type 3) would be designated as a Type 5×3 floodlight.

DETAILED DESCRIPTION OF THE INVENTION

Figure 2:
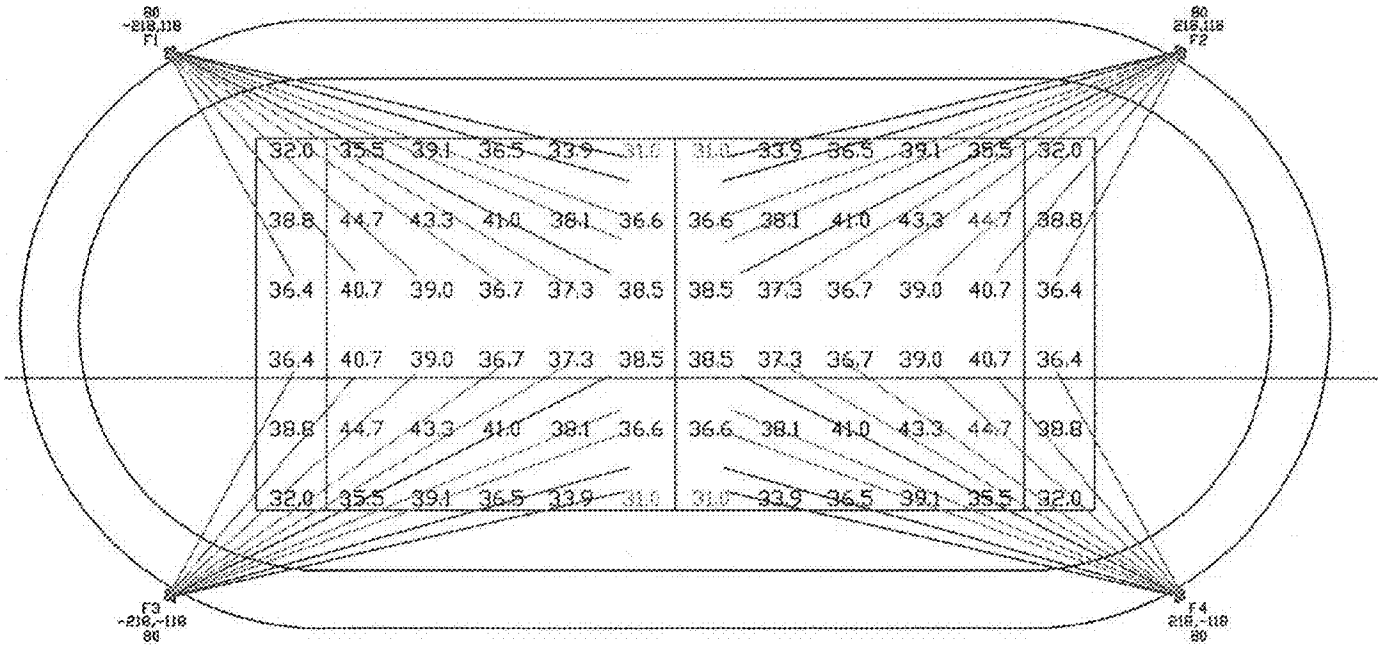
FIG. 2 is a schematic of a football field with a common sports lighting installation by metal halide luminaires in accordance with Illuminating Society of North America's recommended practice.

A description of preferred embodiments of the invention follows.

Description of phenomena related to light can require extensive terminology. Definitions of some of the terms are provided below, prior to the further discussion of the present invention, while some other terms are explained throughout the specification.

The total amount of light, as perceived by humans is often measured as luminous flux. Luminous Flux is the time rate of flow of light, and the lumen (abbreviated as "lm") is the standard unit for the luminous flux of a light source. At a more technical level, Luminous Flux is the energy per unit time that is radiated from a source over visible wavelengths as adjusted for human visual sensitivity (approximately 380 to 780 nm). The lumen (abbreviated as "lm") is the standard unit for the luminous flux of a light source, derived from the SI unit candela, and defined as the luminous flux emitted into unit solid angle by an isotropic point source having luminous intensity of 1 candela.

Herein, we use the term "luminous efficacy" of a source of light to refer to the quotient of the total luminous flux emitted by the lamp and the total power input it receives. It is expressed in lumens per watt (lm/W).

The candela, as officially defined, is the unit of luminous intensity, in a given direction.

Illuminance is the area density of luminous flux incident at a point on a surface which has units of $lm/ft^2$. This is also referred to as the footcandle.

Utilance is the ratio of luminous flux received by the reference surface to the sum of the individual output fluxes of the luminaires of an installation. On the other hand, Utilance, lamp ($U_l$) is the ratio of the luminous flux received by the reference surface to the sum of the rated individual fluxes of the lamps of an installation. This is also called the utilization factor. Since the output flux of a luminaire includes a luminaire efficiency factor and the luminaire efficiency factor varies for lamp type and luminaire size as illustrated in FIG. 1, the best means to compare the energy usage performance of luminaires is to use utilance, lamp as provided herein. In the present invention, utilance, lamp also relates to the ability to deliver light to an intended target without excessive and inefficient spill outside the target area.

Modeling is the effect of directional lighting to enhance depth perception and reveal the shape, texture, and motion of an object or person. Modeling is further elaborated upon in the remainder of this section.

Beam angle is the angle between the two directions for which the intensity is 50% of the maximum intensity as measured in a plane through the normal beam centreline.

Beam shape is the iso-candela curve which illustrates the shape of a beam.

Beam spread, while sometimes confusingly used in the literature, is herein used in the same sense as "field angle", which is defined herein.

Field angle is the angle between the two directions for which the intensity is 10% of the maximum intensity as measured in a plane through the normal beam centreline.

Field efficiency is the ratio of luminous flux (lumens) emitted by a luminaire within a boundary where the beam intensity is at 10% of the maximum intensity as divided by the luminous flux (lumens) emitted by the lamp or lamps used therein.

Key light is illumination of an object from its front to provide the required illuminance for the object to be seen. When used with "back light", the illumination intensity of both is preferred to be approximately equal.

Back light is the illumination of an object from behind to separate the object from its background.

Fill light is illumination directed at an object to provide the illumination from one or two sides which directs light into the shadows produced by "key light" and "back light" at about half (unless another specified percentage is given) of their intensity.

Flat light is the illumination of an object from 6 or more directions producing illumination intensity in these 6 or more directions that are relatively equal, and which does not provide modelling.

Sky glow from sports lighting luminaires is the luminous flux directed above the horizontal plane of a luminaire(s) used to light a sports venue.

A vertical surface is a surface that is perpendicular to the ground.

Maintenance factor is the ratio of the illuminance on a given area after a period of time to the initial illuminance on the same area.

The term uniformity is used herein to refer to the ratio obtained by dividing the maximum horizontal illuminance (footcandles) by the minimum horizontal illuminance (footcandles) among the set of calculation points of a playing field. The calculation points represent measured values for areas that we refer to as "data grid units", which for example can be 30 ft×30 ft for a football or soccer field, or equivalent to an area of 20 ft×20 ft for a little league baseball field or tennis court. Within this document, with the term "football", we refer to the American football, and with the word "soccer", to Association football. The grid details are found in the IESNA Publication LM-5.

A luminaire, as a standard word, refers to a complete lighting unit, consisting of one or more lamps (bulbs or tubes that emit light, which in our case can be one or more LEDs, which in general we also refer to as light sources), along with the socket and other parts that hold the lamp in place and protect it, optionally wiring that connects the lamp to a power source, and optics (e.g., a reflector, lens) that help direct and distribute the light. An LED is a light emitting diode, which is a semiconductor device that produces visible light (or infrared light) when an electrical current is passed through it. LEDs are a type of Solid State Lighting (SSL), as are organic light-emitting diodes (OLEDs) and light-emitting polymers (LEPs).

"Glare" or "appreciable glare" is the sensation produced by luminance within the visual field that is sufficiently greater than the luminance to which the eyes are adapted, which therefore causes annoyance, discomfort, or loss in visual performance and visibility. (As an example, direct sunlight during the daytime, car high beam headlamps at night).

"Luminaire efficiency" is the ratio of total lamp lumens to total lumen output of the luminaire. This number is often provided by manufacturers. Within this document, the word "efficiency" is sometimes used instead of "luminaire efficiency".

Regarding the development of sports lighting technology, in the past 40+ years since the introduction of the metal halide lamp and its prominent use in sports lighting installations, the 1500 watt lamp has somewhat increased in efficacy (lumens per watt or lpw) to the present value of 110 lpw for the most commonly used lamp in sports lighting. White light LEDs, used in the assembly of the present invention, have now reached an efficacy of over 110 lpw, and white light LEDs are rapidly becoming available which produce about 200 lpw. In addition, there are (LED) lamps that will provide 300 lpw. Arrays of white light LEDs can be used in the present invention to illuminate sports facilities. The luminaires having LEDs are assembled in such a way in the present invention to achieve a high percentage of modeling across the playing area while having utilance, lamp ($U_l$) greater than about 50% (e.g., 55%, 60%, 65%, 70%, 75%, 80%, 85%, 90%, 95%). Previous sports lighting installations neither used LEDs, nor assembled luminaires in a way to achieve the $U_l$ and modeling percentage values that are obtained by the embodiments of the present invention.

Figure 3:
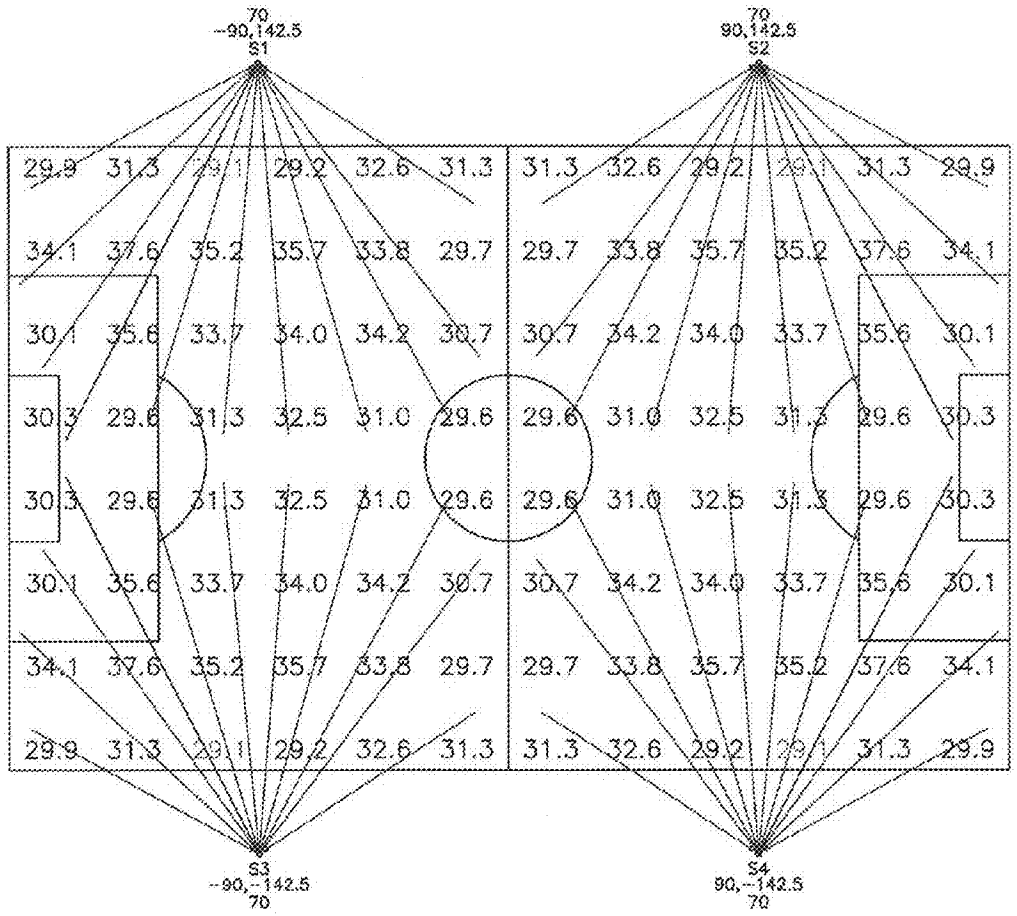
FIG. 3 is a schematic of a soccer field with a common sports lightning lighting installation illuminated by metal halide luminaires in accordance with Illuminating Society of North America's recommended practice.
Figure 4A:
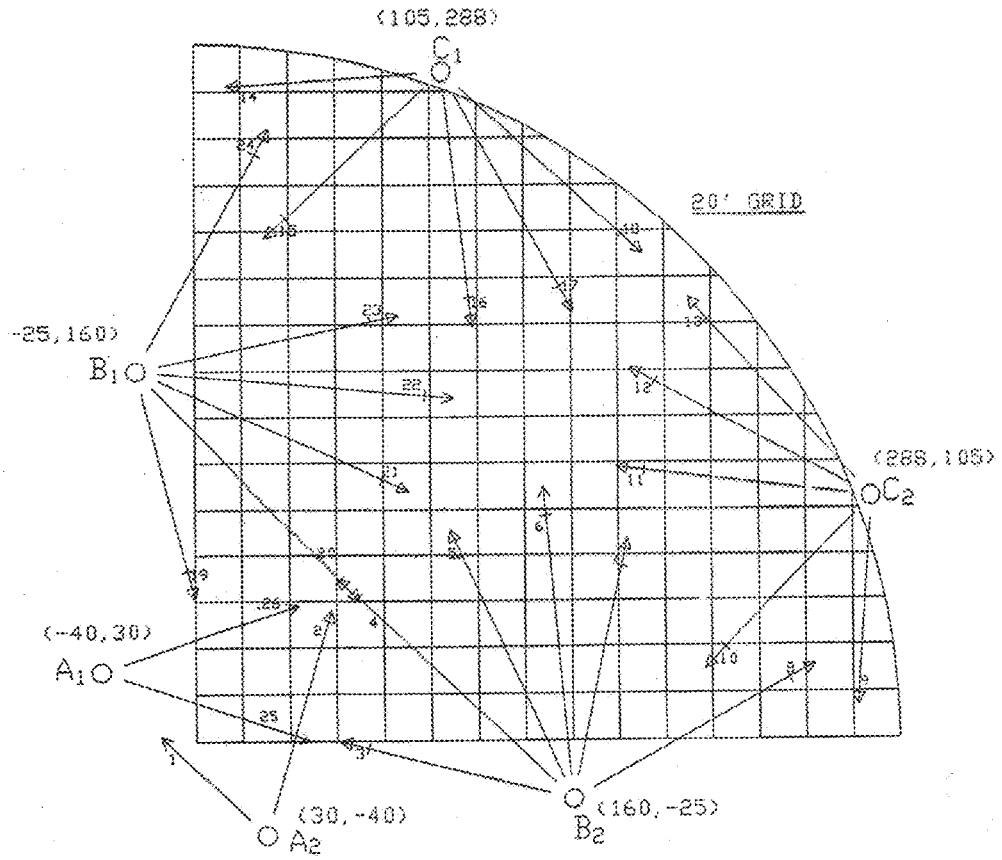
FIG. 4A is a schematic of a baseball field with a common sports lighting installation illuminated by metal halide luminaires in accordance with Illuminating Society of North America's recommended practice. The baseball field has 60' between bases and the calculated data is on 20' centers.
Figure 4B:
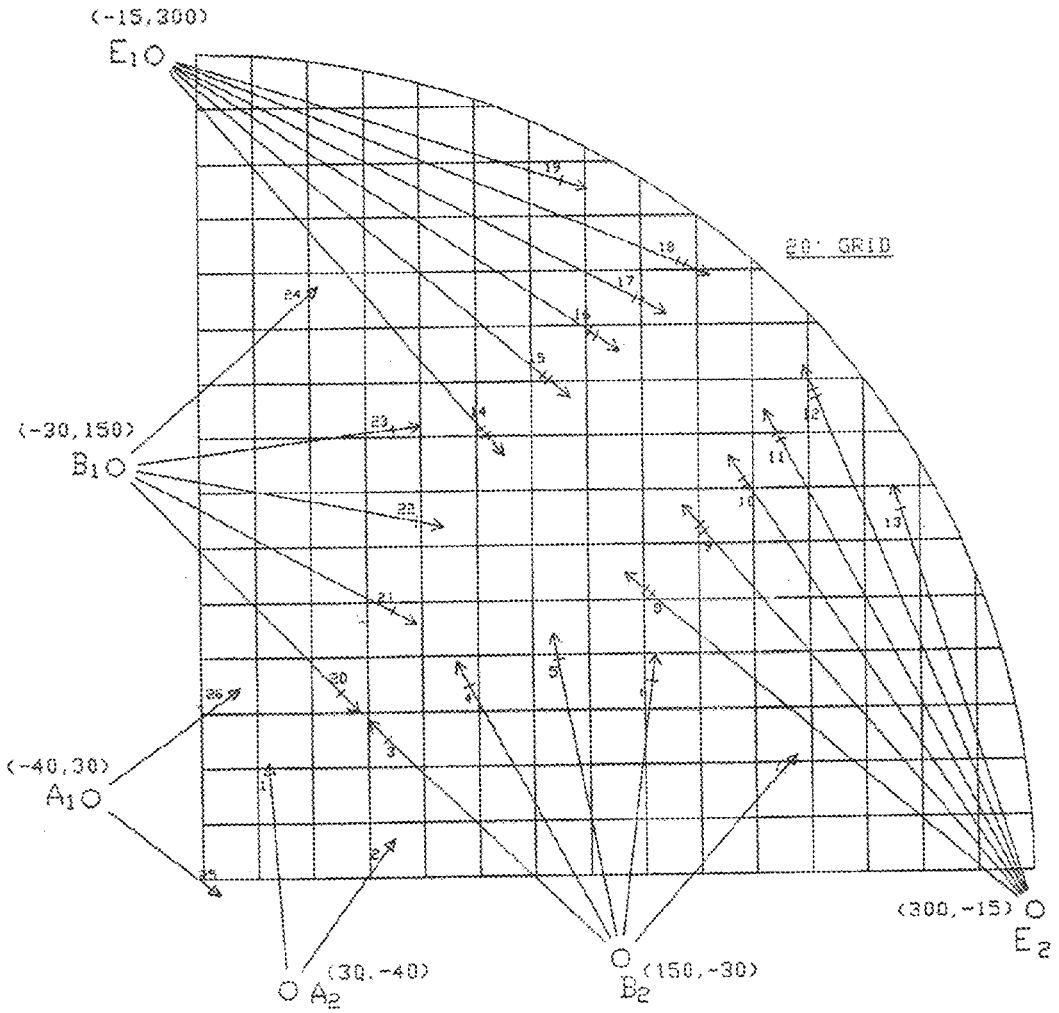
FIG. 4B is a schematic of a baseball field with another common sports lighting installation illuminated by metal halide luminaires in accordance with Illuminating Society of North America's recommended practice. The baseball field has 60' between bases and the calculated data is on 20' centers.
Figure 5:
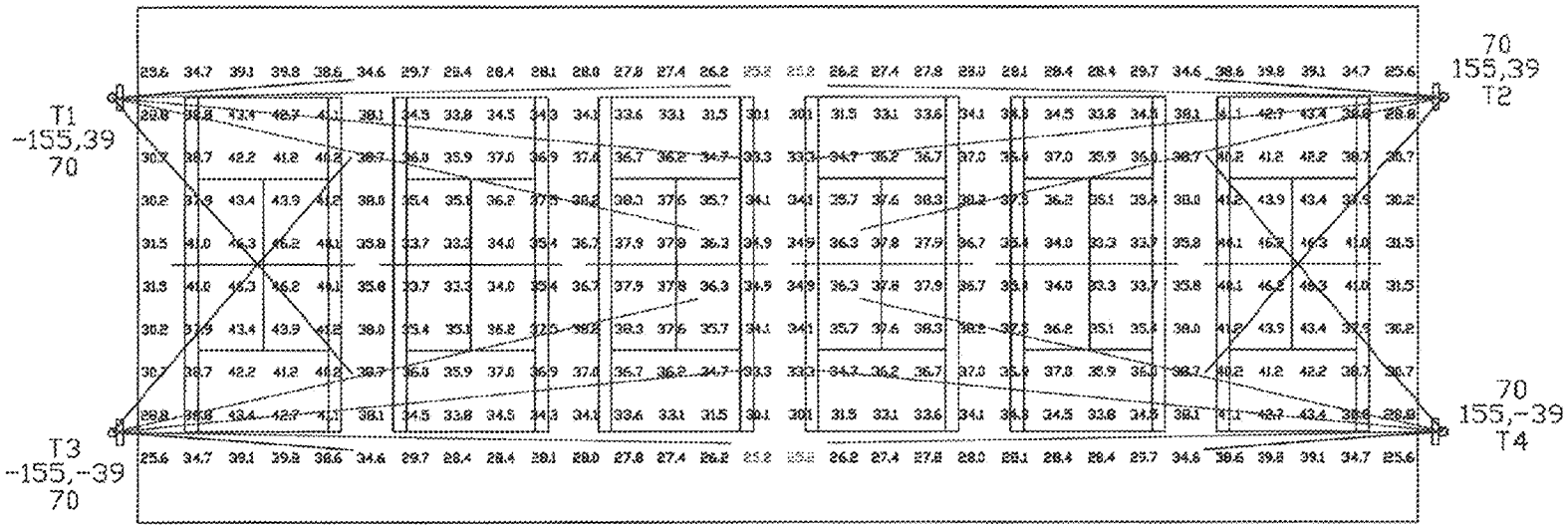
FIG. 5 is a schematic of three pairs of tennis courts showing illuminance values attained with a sports lighting installation illuminated by metal halide luminaires.

Some sports lighting installations illuminated by 1500 watt metal halide luminaires are shown in FIG. 2 for a football field, FIG. 3 for a soccer field, FIG. 4A and FIG. 4B for a baseball field, and FIG. 5 for six tennis courts. A common pole location (hence a luminaire location, since the pole positions the light sources) for football and soccer fields, especially in Europe, is the four corners as shown in FIG. 2. Providing light from the sides of a football or soccer field as in FIG. 3, often depends on having seating on one or both sides with the poles located behind the seating. The height of poles depends on the distance from the pole to the center of the field, the beam size, and the requirement to limit spill light. In general, narrow beams can be mounted lower than wide beams (which direct more light up into the sky at lower mounting heights). The luminaire assembly of the present invention can utilize pole placement in a similar manner as shown in these figures and achieve better modelling and efficiencies, at least due to replacing metal halide luminaires with LED luminaires that include NEMA type 0 beam LED luminaires. In these settings, the assembly of LEDs of the present invention can obtain modelling (e.g., key light and fill light of certain amounts aimed at certain locations, as further described herein) in most of the playing area and without much spillage. In addition to such improvements, different configurations of the mounts can be used that further take advantage of the possibilities offered by concepts behind LEDs and NEMA type 0 beams. For example, compare the locations of poles in FIG. 2 with those in FIG. 11 for a football field. Similarly, compare the locations of the poles in FIG. 3 with those in FIG. 10 for a soccer field. As seen, with different types of light sources, with different types of luminaire locations, and with different ways of directing these lights onto a playing area, many cumulative advantages are attained with various embodiments of the present invention.

FIG. 1 is a table that shows and defines seven beam types, designated as NEMA types 1 through 7. It does not include a NEMA type 0 beam type, which is a beam type introduced and used by the present invention. The phrase "beam spread" in this table is intended to mean "field angle", which is the angle between the two directions for which the intensity is 10% of the maximum intensity as measured in a plane through the normal beam centerline. Even though the seven designations in the table, taken alone, refer to symmetrical beam floodlights, asymmetrical beam floodlights can be designated by a combination type designation which indicates the horizontal and vertical beam spreads in that order, e.g., a floodlight with a horizontal beam spread of 75 degrees (Type 5) and a vertical beam of 35 degrees (Type 3) would be designated as a Type 5×3 floodlight. It is possible to designate beams in alternative ways, for example by including information related to their lateral field angles, vertical field angles, and luminaire field lumen efficiencies.

One component of some embodiments of the present invention is the NEMA type 0 beam light. Such a beam type is absent from tables found in the relevant literature, as it has not been defined or used for sports lighting. As we define it herein, a NEMA type 0 beam has a beam spread of less than 10 degrees. Because of that, it can travel farther than any of NEMA types 1 through 7 (some of the typical distances for these types are provided in Table 4) to provide a desired light level over a desired area. The conception of NEMA type 0 beams for lighting sports venues, when coupled with the conception of which beam installation configurations and which beam aimings lead to optimal modelling, results in many of the advantages of the present invention. As an example, NEMA type 0 beams can be aimed all the way at the opposite sides of a playing area, where they can cross paths with beams from other light sources. The patterns created by different light sources, for instance an elliptical pattern that has relatively large diameters and another elliptical pattern that has relatively smaller diameters can cross near their boundaries (visually resembling a Venn diagram having two sets in which they have an intersection about half the area of the smaller set). Such a crossing of beams can create good modelling for the spot where the beams cross. While extensive crossings of beams like that have not been achieved for sports lighting, the present invention opens the door to various LED luminaire installations where such beam aimings and crossings create very effective modelling.

FIG. 2 is a schematic for a football field. Some of the details of the lighting installation of FIG. 2 are shown in Table 1.

TABLE 1

| Pole # & Height | # Luminaires & NEMA Type | Lamp Wattage | Lamp Lumens |
|---|---|---|---|
| F1 - 80' | 3 - Type 2 | 1500 | 155,000 |
| | 5 - 4 × 3 | 1500 | 155,000 |
| | 2 - 4 × 4 | 1500 | 155,000 |
| F2 - 80' | 3 - Type 2 | 1500 | 155,000 |
| | 5 - 4 × 3 | 1500 | 155,000 |
| | 2 - 4 × 4 | 1500 | 155,000 |
| F3 - 80' | 3 - Type 2 | 1500 | 155,000 |
| | 5 - 4 × 3 | 1500 | 155,000 |
| | 2 - 4 × 4 | 1500 | 155,000 |
| F4 - 80' | 3 - Type 2 | 1500 | 155,000 |
| | 5 - 4 × 3 | 1500 | 155,000 |
| | 2 - 4 × 4 | 1500 | 155,000 |

For this table, the football field, having a total area of 360'×180' (=64800 $ft^2$), is divided into 72 grid units, resulting in 72 calculation points. Each grid unit is 30 ft by 30 ft. The resulting average footcandles are 37.7, while the maximum and mimimum footcandles are 44.7 and 31, respectively. The max/min uniformity is 1.44. The calculated utilance, lamp is 39.4%. This can be calculated from these values as follows: (72×900×37.7)/(40×155,000), where 72 is the number of calculation points, 900 is the area of one grid unit (30×30) represented by one calculation point, 37.7 is the average footcandle value of a calculation point, 40 is the total number of luminaires, and 155,000 is the lamp lumens for each luminaire.

The utilization factor, also referred herein as the "utilance, lamp", and abbreviated as $U_l$, is the ratio of the luminous flux received by the reference surface to the sum of the rated individual fluxes of the lamps of the installation. The "utilance, lamp" of a lighting installation is a method to judge how efficiently a lighting system illuminates a sports field. With the design of a sports field to obtain a specified light level, a utilance, lamp value is easily calculated. As an example, assume that a two court tennis facility contains 12,000 square feet of illuminated area which if illuminated to 30 footcandles requires 360,000 lumens of illumination. Two courts installation often uses 12-1000 watt metal halide luminaires where each lamp has a lumen rating of 110,000 lumens. The 12 luminaires therefore have a total of 12 times 110,000 for a total of 1,320,000 available lamp lumens. By dividing the required facility illumination lumens by the available rated lamp lumens we find that the utilance, lamp of this lighting installation is 27.3%. It is normal for a metal halide lamp installation to lose 40 to 50% of its light output during the operation of the lighting system requiring a design to initially over illuminate the playing area to maintain the desired light level. The results identified in this example are somewhat lower than other examples, but $U_l$ values that exceed 50% are rarely obtained using metal halide lamps due to the poor lamp lumen maintenance. The range of utilance, lamp values we have found in metal halide sports lighting installations is normally 30 to 40%. Applying $U_l$ calculations to the sample LED sports lighting installations using the luminaire assembly of the present invention, some of the utilance, lamp calculations have varied from about 60% to 75%. The LEDs and our ways of configuring them therefore can produce at least 1.5 times the lpw of the present metal halide lamps and the LED luminaire assemblies used in the present invention can achieve greater utilance, lamp than is available from metal halide lighting systems.

In various embodiments of the present invention, the mounts can be placed in similar ways to those in this figure (FIG. 2). The usage of LEDs and the distant reach of NEMA type 0 beams would be, even without further changes, an improvement over the older methods. Due to the power of the beams of the present invention, the poles can be placed lower (even at the same locations) as compared to the poles used in the previously known installations. Such an installation would achieve improved beam crossing, improved modeling, and improved efficiency. Implementing different ways of placing the mounts, for example as disclosed in FIG. 11 for a football field, the utilance, lamp values, the illuminance uniformity values, and the percentage of the modeled area can be improved even further. A comparison of various figures for football field installations demonstrates some of these advantages (e.g., compare FIG. 2 with FIGS. 11, 15, and 19).

FIG. 3 is a schematic of a soccer field, with a design in accordance with Illuminating Society of North America standards. Some of the details of the lighting installation of FIG. 3 are shown in Table 2.

TABLE 2

| Pole # & Height | # Luminaires & NEMA Type | Lamp Wattage | Lamp Lumens |
|---|---|---|---|
| S1 - 90' | 1 - Type 2 | 1500 | 155,000 |
| | 4 - 4 × 3 | 1500 | 155,000 |

TABLE 2-continued

| Pole # & Height | # Luminaires & NEMA Type | Lamp Wattage | Lamp Lumens |
|---|---|---|---|
| | 6 - 4 × 4 | 1500 | 155,000 |
| S2 - 90' | 1 - Type 2 | 1500 | 155,000 |
| | 4 - 4 × 3 | 1500 | 155,000 |
| | 6 - 4 × 4 | 1500 | 155,000 |
| S3 - 90' | 1 - Type 2 | 1500 | 155,000 |
| | 4 - 4 × 3 | 1500 | 155,000 |
| | 6 - 4 × 4 | 1500 | 155,000 |
| S4 - 90' | 1 - Type 2 | 1500 | 155,000 |
| | 4 - 4 × 3 | 1500 | 155,000 |
| | 6 - 4 × 4 | 1500 | 155,000 |

For measuring the illuminance values (in the units of footcandles), the soccer field (360'×225') is divided into 96 grid units each being 30 ft by 30 ft. The measured values have the following statistics for horizontal footcandles: Average: 32.2; Maximum: 37.6; Minimum: 29.1; Max/Min: 1.29. A utilization factor of 40.8% can be calculated from these values as follows: (96×900×32.2)/(44×155,000).

In various embodiments of the present invention, the mounts can be placed in similar ways to those in this figure. The usage of LEDs and the distant reach of NEMA type 0 beams would be, even without further changes, an improvement over the older methods. Due to the power of the beams of the present invention, the poles can be placed lower (even at the same locations) as compared to the poles used in the previously known installations. Such an installation would achieve improved beam crossing, reduced spill light, reduced glare to the neighbors, improved modeling, and improved efficiency. Implementing different ways of placing the mounts, for example as disclosed in FIG. 10 for a soccer field, the utilance, lamp values, the illuminance uniformity values, and the percentage of the modeled area can be improved even further. A comparison of various figures for soccer field installations demonstrates some of these advantages (e.g., compare FIG. 3 with FIGS. 10, 14, and 18).

FIG. 4A is a schematic of a baseball field, having 25 calculation points infield, and 163 calculation points outfield. The average footcandles are 30.1 for infield, and 20.1 for outfield. Max/Min Uniformity (the ratio of the maximum footcandle value and the minimum footcandle value) is 1.49 for the infield and 1.99 for the outfield. The playing area is 10,000 $ft^2$ for the infield and 65,200 $ft^2$ for the outfield. These values result in a utilization factor of 40.0%. Installation details for FIG. 4A are provided in Table 3A below.

TABLE 3A

| Pole # & Height | # Luminaires & NEMA Type | Lamp Wattage | Lamp Lumens |
|---|---|---|---|
| A1 - 60' | 2 - 4 × 4 | 1500 | 155,000 |
| A2 - 60' | 1 - 4 × 3 | 1500 | 155,000 |
| | 1 - 4 × 4 | 1500 | 155,000 |
| B1 - 60' | 5 - 4 × 4 | 1500 | 155,000 |
| | 1 - 4 × 3 | 1500 | 155,000 |
| B2 - 60' | 5 - 4 × 4 | 1500 | 155,000 |
| | 1 - 4 × 3 | 1500 | 155,000 |
| C1 - 60' | 5 - 4 × 4 | 1500 | 155,000 |
| C2 - 60' | 5 - 4 × 4 | 1500 | 155,000 |

FIG. 4B is also a schematic of a baseball field. The values of it that differ from those of FIG. 4A are as follows: average footcandles for infield is 30.3, and for outfield 20.0; Max/Min Uniformity is 1.99 for the infield and 2.9 for the outfield. These values result in a utilization factor of 39.9%. Installation details for FIG. 4B are provided in Table 3B below.

TABLE 3B

| Pole # & Height | # Luminaires & NEMA Type | Lamp Wattage | Lamp Lumens |
|---|---|---|---|
| A1 - 60' | 2 - 4 × 4 | 1500 | 155,000 |
| A2 - 60' | 2 - 4 × 4 | 1500 | 155,000 |
| B1 - 60' | 5 - 4 × 3 | 1500 | 155,000 |
| B2 - 60' | 5 - 4 × 3 | 1500 | 155,000 |
| E1 - 60' | 5 - Type 2 | 1500 | 155,000 |
| | 1 - 4 × 3 | 1500 | 155,000 |
| E2 - 60' | 5 - Type 2 | 1500 | 155,000 |
| | 1 - 4 × 3 | 1500 | 155,000 |

The placement of luminaires as shown in these figures (FIGS. 3A and 3B) is encompassed by various embodiments of the present invention. The usage of LEDs and the distant reach of NEMA type 0 beams would be, even without further changes, an improvement over the older methods. Due to the power of the beams of the present invention, the poles can be placed lower (even at the same locations) as compared to the poles used in the previously known installations. Such an installation would achieve improved beam crossing, reduced spill light, reduced glare to the neighbors, improved modeling, and improved efficiency. Implementing different ways of placing the mounts, for example as disclosed in FIG. 12 for a baseball field, the utilance, lamp values, the illuminance uniformity values, and the percentage of the modeled area can be improved even further. A comparison of various figures for baseball field installations demonstrates some of these advantages (e.g., compare FIG. 4A/4B with FIGS. 12, 16, and 20).

FIG. 5 is a schematic in which three pairs of tennis courts have a system of luminaires installed around them as detailed in Table 4.

TABLE 4

| Pole # & Height | # Luminaires & NEMA Type | Lamp Wattage | Lamp Lumens |
|---|---|---|---|
| T1 - 70' | 3 - 4 × 3 | 1500 | 155,000 |
| | 2 - 4 × 4 | 1500 | 155,000 |
| T2 - 70' | 3 - 4 × 3 | 1500 | 155,000 |
| | 2 - 4 × 4 | 1500 | 155,000 |
| T3 - 70' | 3 - 4 × 3 | 1500 | 155,000 |
| | 2 - 4 × 4 | 1500 | 155,000 |
| T4 - 70' | 3 - 4 × 3 | 1500 | 155,000 |
| | 2 - 4 × 4 | 1500 | 155,000 |

For measuring the illuminance values (in the units of footcandles), the total area of the three pairs of tennis courts (300'×100') is divided into 300 grid units, each being 10 ft by 10 ft. The measured values have the following statistics for horizontal footcandles: Average: 34.5; Maximum: 46.3; Minimum: 25.2; Max/Min: 1.84. A utilization, lamp of 34.5% can be calculated from these values as follows: (300×100×34.5)/(20×155,000).

The placement of luminaires as shown in this figure is encompassed by various embodiments of the present invention. The usage of LEDs and the distant reach of NEMA type 0 beams would be, even without further changes, an improvement over the older methods. Due to the power of the beams of the present invention, the poles can be placed lower (even at the same locations) as compared to the poles used in the previously known installations. Such an installation would achieve improved beam crossing, reduced spill light, reduced glare to the neighbors, improved modeling, and improved efficiency. Implementing different ways of placing the mounts, for example as disclosed in FIG. 13 for a pair of tennis courts, the utilance, lamp values, the illuminance uniformity values, and the percentage of the modeled area can be improved even further. A comparison of various figures for tennis court installations demonstrates some of these advantages (e.g., compare FIG. 5 with FIGS. 13, 17, and 21).

Figure 6:
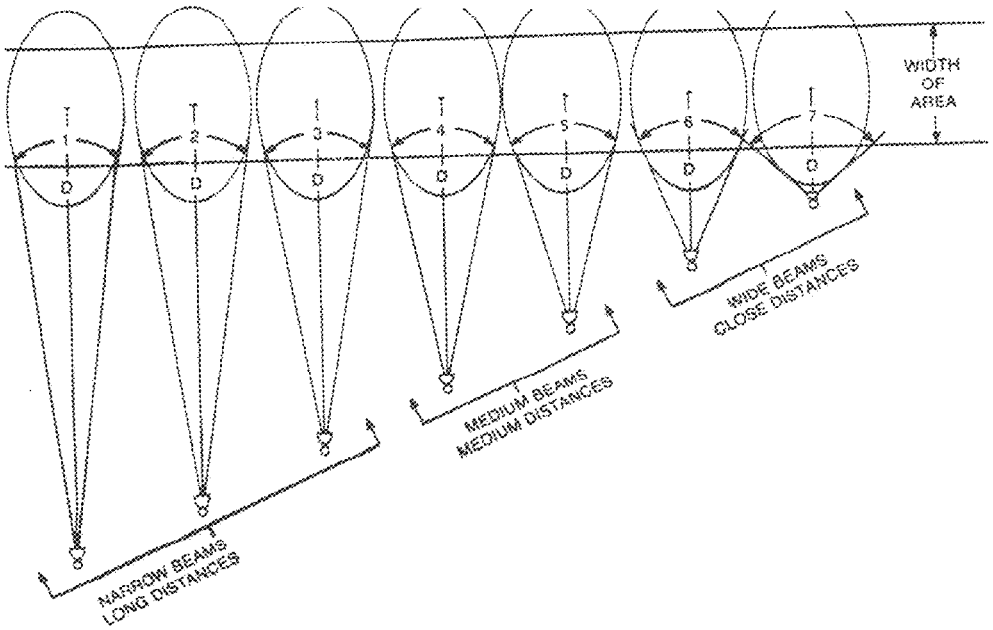
FIG. 6 is a schematic that can be used as a general guide for choosing projection distance for the various NEMA Beam Types.

FIG. 6 is a general guide for the choice of projection distance for the various NEMA Beam Types. This illustration shows that as the luminaire beam angle increases the distance can be reduced from the luminaire location to the location where a desired light level and pattern of illuminated playing area is desired. It is therefore easily concluded that the NEMA type 0 beam will allow the greatest distance between the luminaire and illuminated area.

In baseball, with a 90 foot distance between the bases, the most common pole locations are shown in FIG. 4A, where the two outfield "C" poles are sometimes increased to 4 poles. For 60 foot base separation used for little league baseball fields, the normal "B" pole location can be moved to the outfield corner as pictured in FIG. 4B. The three poles as shown in FIG. 4B can be used to eliminate the outfield "C" poles when narrow beam luminaires are available to illuminate the outfield, and the desire is to illuminate the outfield by directing luminaires perpendicular to the direction of play. The most common method of illuminating tennis courts is to illuminate pairs of courts from four poles along the sides of the court as shown in FIG. 5. This illumination of tennis courts from the side allows the playing area to be illuminated by directing luminaires perpendicular to the direction of play. Some guideline projection distances, based on FIG. 6, are presented in Table 5.

TABLE 5

| Beam Type | Field Angle Degree Range | Projection Distance |
|---|---|---|
| 1 | 10 to 18 | 240 ft and Greater |
| 2 | 18 to 29 | 200 to 240 ft |
| 3 | 29 to 46 | 175 to 200 ft |
| 4 | 46 to 70 | 145 to 175 ft |
| 5 | 70 to 100 | 105 to 145 ft |
| 6 | 100 to 130 | 80 to 105 ft |
| 7 | 130 and up | Under 80 ft |

This table does not include NEMA type 0, which is defined and introduced in this document. NEMA type 0 beams have a beam spread that is less than 10 degrees and they can reach distances greater than 300 feet. Usage of such beam types, when implemented with ways of configuring the placement of the luminaires and ways of aiming the light beams in certain ways against each other, can create modeling percentages that have never been achieved before.

Figure 7:
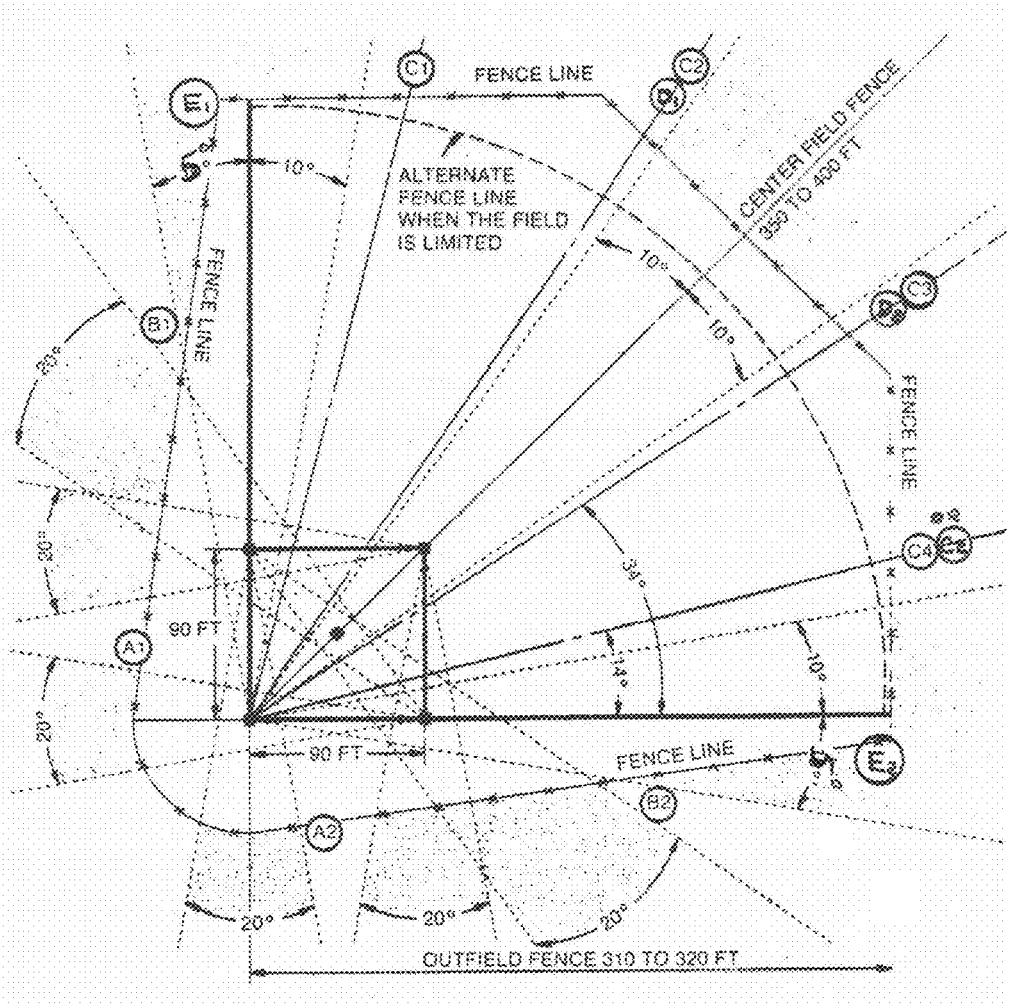
FIG. 7 is a schematic of a baseball/softball field showing zones where luminaires can be located.
Figure 8:
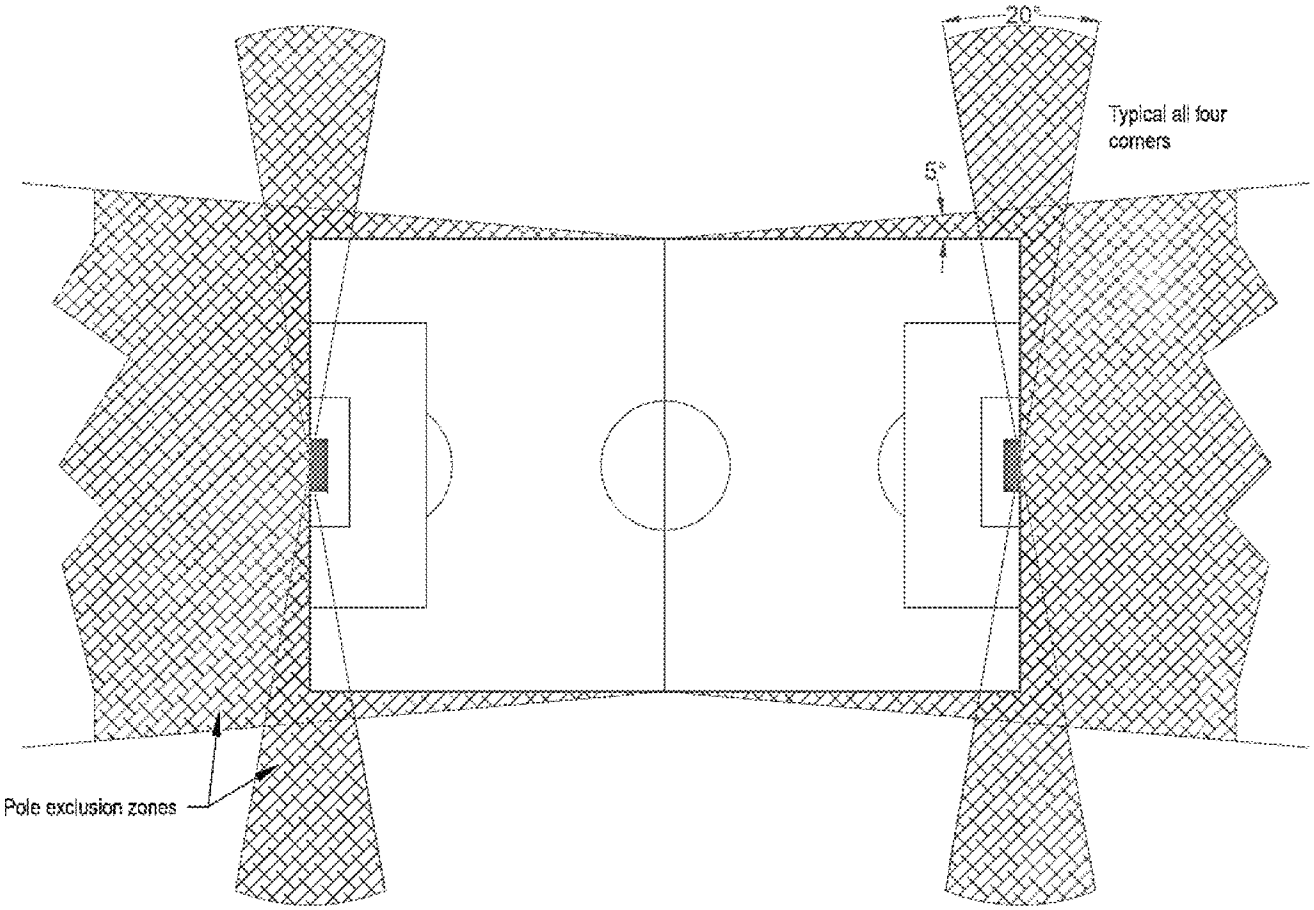
FIG. 8 is a schematic of a soccer field showing where corner and sideline poles can be located.

Some guidelines are presented for locating poles around sports fields to limit glare for the players based on their normal viewing directions. FIG. 7 provides the zones where luminaires of the present invention can be located (the letter-number references within circles in the figure represent the locations) for baseball and softball and FIG. 8 provides where corner and sideline poles for luminaires of the present invention can be located for soccer. In an embodiment, locations are symmetric around the center of the playing area (e.g., each pair of poles is positioned equidistantly from the center along a shared axis). Since arrays of LEDs are brighter than metal halide lamps, the location and aiming direction of arrays of LEDs would be a greater concern (e.g., due to lamp glare) in sports facilities illuminated by LEDs. The method recommended herein to limit glare for players is to aim luminaires perpendicular to the most common direction of play ±40°. Glare is also an issue for spectators when the luminaires on the opposite side of the playing field are directed towards the face of the spectators. The solution is to illuminate spectators from behind and from their sides. It should also be noted that NEMA type 0 luminaires can be directed at playing areas in front of spectators since the beams will only illuminate the ground in front of the spectators without directing part of the beam into the seating area producing glare. Glare is also an issue for neighbors when beams of light spill onto neighboring property or lamps are not shielded from view of neighbors. A common mistake is to use tall poles with luminaires which have beams greater than NEMA Type 3 aimed down onto the playing field rather than the lowest possible poles with luminaires having beams narrower than NEMA type 3. When tall poles result in the luminaires being above trees and buildings that would block the view of the luminaires, a neighbor sees the luminaires against the dark sky resulting in any glow of light that the luminaire produces being perceived as a glare source by a neighbor. This perception comes from the fact that the brightest source of illumination seen by the eye is perceived as a glare source.

Due to the greater efficiency of NEMA type 0 beams and due to their greater reach, poles from which such beams initiate do not need to be as high as the poles from which weaker beams emanate. Reducing the pole height, in turn, can decrease light spilling out of the playing area and glare reaching the neighboring areas. Therefore, the present invention overcomes these problems, for example as shown in FIGS. 10 through 21, by using LED luminaires with predominately NEMA type 0 and 1 beams are aimed substantially perpendicularly to the playing direction.

Figure 9:
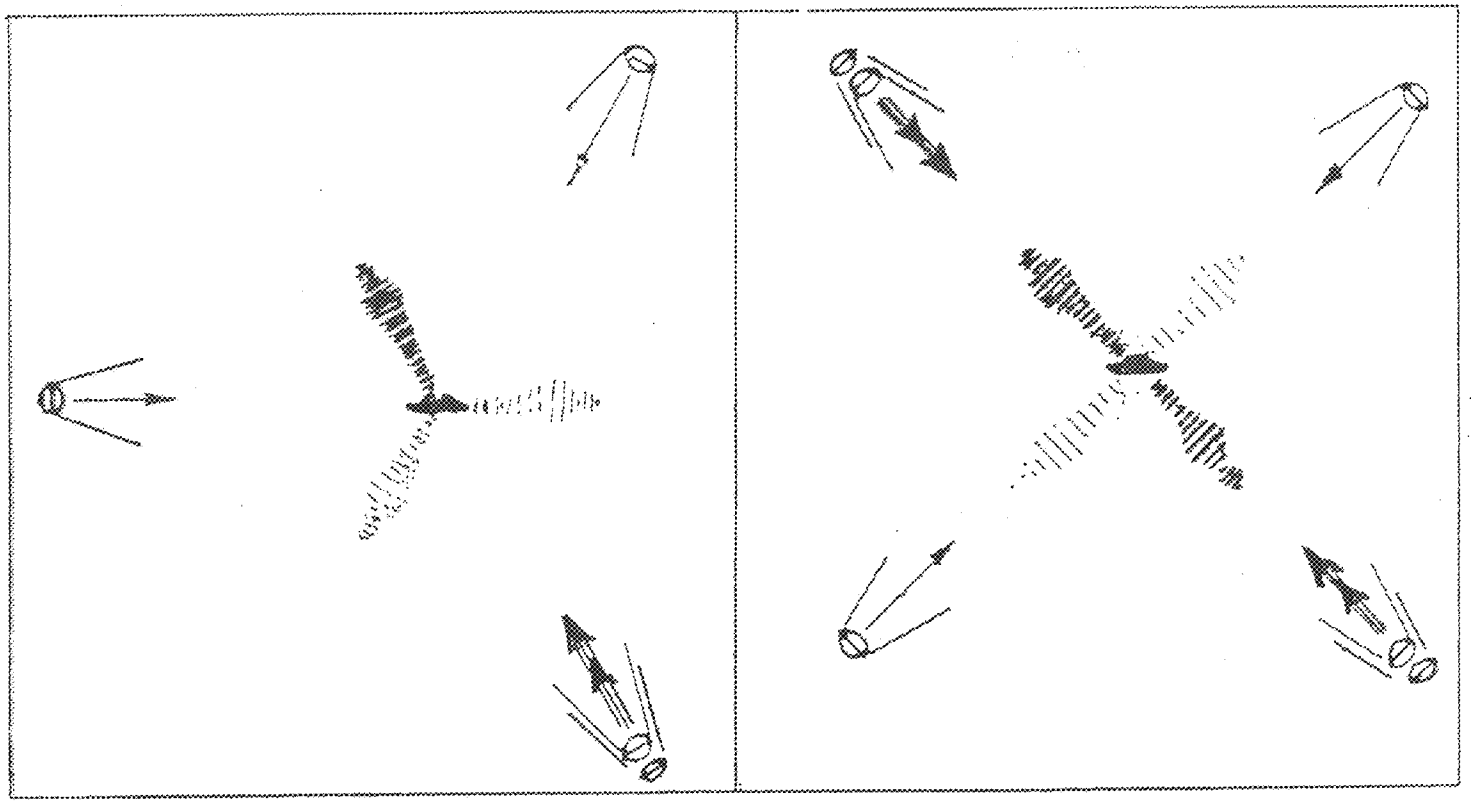
FIG. 9 is a schematic showing two ways of delivering light onto a playing field to provide modeling. Panel (A) shows a key light and two fill light providers, in which the key light has an intensity that is twice as much as that of fill light. Panel (B) shows a key light, a back light, and two fill light providers, in which the intensity of the fill light is about 40% of the key and the back light.

Another issue related to the aiming of luminaires is a desire to provide modelling of people and objects provided by the illumination system. Modelling is the ability of the lighting system to reveal the three dimensional image of an object, for example a ball, a target, or a player which reveals the spin of a ball, its path of flight, or the facial expression of an opponent. The present invention uses LED luminaires to provide such modeling. FIG. 9 illustrates how light produced by the present invention uses LED luminaires to obtain modelling by delivering light from either 3 or 4 directions at each point on a playing field. Lighting for TV and film, which also benefits from modelling, is normally provided by a "key" light from the front of a subject and a "back" light from the rear which are both twice the intensity of the "fill" light which comes from the side of a subject. It should be identified that the terms "key" and "back" light are related to the direction of viewing an object from a location that can be directly in front of the object +/−90°. Over most of a sports venue the locations on the playing field are viewed from all directions or 360°. This is provided by "key" and "back" light since when an object is viewed from an opposite direction the "back" light becomes the "key" light and the "key" light becomes "back" light. When lighting is provided from only 3 directions without "back" light, modeling is only provided in the viewing direction of the "key" light +/−90°. The shadows produced by "key", "back" and "fill" light as illustrated in FIG. 9 provides a visual illustration of how modelling is produced by 3 and 4 beams of light.

This can be understood by considering the illumination provided by the sun and sky light provided on a sunny day. As the number of directions of light that illuminate an object increases, the resultant shadows and highlights increase resulting in no shadows or highlights or "flat" lighting similar to what is provided on a cloudy day. When modelling is provided, the spin of a ball and its flight path can be seen which improves the ability to hit and catch a ball as well as the ability to see the opponent's facial expression to judge their intention. The one difference which sunlight provides is that the sun is the provider of "key" light and the sky provides a uniform intensity or "fill" light from all directions which results in sunlight providing modeling from all viewing directions.

Modelling is a desired attribute for all sports lighting systems since lighting that reveals the depth, shape, and texture of an object or person is desirable. The inability for metal halide luminaires to produce very narrow beams of illumination has limited the area of a playing field where modelling is obtained. Since the LED luminaires of the present invention are aimed from the side of players to limit glare, modelling can be obtained by providing the greatest illumination at each point on the playing field from two sides ±40° resulting in providing key and back light at these points with fairly equal values of illumination. In addition fill light is required at these points from at least one and hopefully two opposite directions that are 90°±30° to the direction of the key and back light direction as illustrated in FIG. 9, panel B. Often it is not possible to have light directed from 4 directions at each point on the playing field but lighting from three directions as illustrated in FIG. 9, panel A will also provide modelling. Since the present invention uses very narrow, intense NEMA Type 0 beams, it is possible to illuminate at least 75% of a playing field from at least 3 and possibly 4 directions with illumination intensities that provide modelling. FIGS. 18-21 illustrate the success achieved in modeling by some of the installations of the present invention. Generally, if the lighting only comes from one or two directions or six or more directions the result will produce either harsh shadows or so many shadows that no modelling is obtained.

In the present invention, LED luminaires are used instead of existing metal halide luminaires that have beam patterns that are rated NEMA Types 3, 4, or 5. LED luminaires, however, can produce very narrow, high intensity beams as well as a full range of wider beams. In fact, LEDs used in the present invention can produce luminaire beams that are narrower than 10 degrees which we term a NEMA Type "0" beam (having a field angle of less than 10°). A very narrow beam from an array of LEDs can be made wider by adding optical elements to each LED or the array of LEDs which slightly reduces the efficiency of the array. As illustrated by the NEMA Beam data in FIG. 1, normal floodlights have lower beam efficiency as their beam gets narrower. An LED luminaire has its greatest efficiency from a NEMA Type 0 beam, which can be 80% to 90%. Each wider beam will have beam efficiencies that is less than 80% to 90%, but over 70%. A luminaire assembly of the present invention can provide the best sports lighting performance with beams designated NEMA Type 0, 1, 2, 3, 4, and 5. Such an assembly has the advantage of producing lighting layouts that were not possible using 1500 watt incandescent or metal halide luminaires that could not produce either a NEMA Type 0 beam with incandescent lamps or a NEMA Type 0, 1 and 2 with metal halide lamps. The incandescent and metal halide lamp narrow beam luminaires had efficiencies that were in the 34% to 40% range rather than 80% to 90% obtainable from LED luminaires which further limits the metal halide luminaire performance.

The LEDs and/or optics used with the present invention are commercially available, and can be purchased, for example, from Ephesus Lighting.

Because the beams produced by LEDs in the present invention can provide such highly efficient narrow beams, new aiming considerations are used. The aiming of luminaires illustrated by the results in FIGS. 2, 3, 4, and 5 are what we call short aiming. Few luminaires are aimed beyond the aiming location of the opposite luminaires. Without this crossing of the luminaire aiming, modelling is not obtained except at the location where the beams almost meet at the center of the field. The present metal halide luminaires which provide NEMA Type 3, 4, and 5 beams that are available from sports lighting luminaire manufacturers therefore suffer when compared to the present invention since they had lower beam efficiencies and wider beams.

Figure 10:
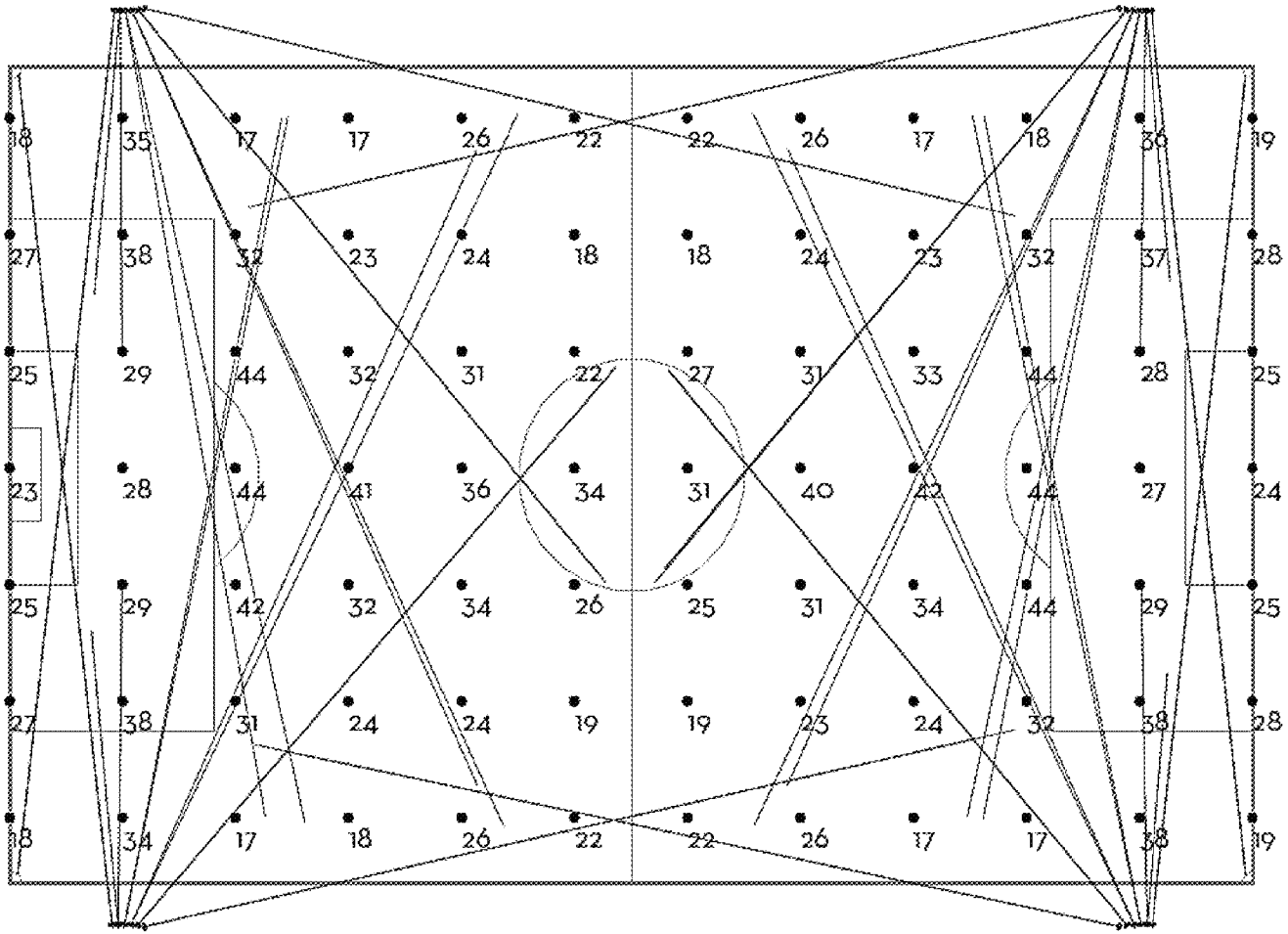
FIG. 10 is a schematic of a soccer field showing an exemplary installation of an LED luminaire assembly of the present invention in which horizontal illuminance values are shown for each calculation point.

Since the LED luminaires can be cross aimed with opposite luminaires to obtain modelling and since this cross aiming can be perpendicular to the player's line of sight, glare is not obtained. The LED luminaires must therefore be aimed in directions where players do not normally look while playing their sport. For football, this means aiming luminaires perpendicular ±40° to the centerline of the playing field. This becomes challenging when using four corner poles for football and soccer fields. In soccer, the goalie also has a need to see corner kicks which adds a limitation for luminaires in the immediate area of the four corners. For baseball, the luminaires must typically be positioned within the limits outlined in FIG. 7, which addresses the normal viewing direction limits for the players. The direction of player viewing is generally in the direction of home plate resulting in a desire to aim the LED luminaires perpendicular to the field centerline that runs from home plate to center field while missing the throwing lanes by infielders toward the various bases. For tennis courts, the aiming must typically be from locations along the side of the court(s) and not from the back corners of the court(s). Examples of the positions of a luminaire assembly of the present invention are shown in FIG. 10 (soccer), 11 (football), 12 (baseball) and 13 (tennis).

When designing metal halide luminaires for sports lighting, an asymmetric beam with as little light above the point of maximum beam candlepower is desirable as identified by the information in two U.S. Pat. Nos. 4,864,476 and 5,313,379. These designs have identified that the least angle between the maximum candela and the upper beam cutoff for metal halide luminaires is 10° to 15°. Using this luminaire assembly of the present invention where the NEMA Type 0 luminaire that has a 9° beam is aimed to locations near the opposite end or sideline, very little light is spilled beyond the sports field since the center of the beam is aimed onto the field and less than half of the upper 4.5° of the beam is directed beyond the edge of the playing field. The aiming of all LED luminaires with wider beams are then limited in use to directing their light into areas within the playing field which limits little of their beams to be directed beyond the playing area. Therefore, nearly all of the light produced by the LED luminaires will remain on the playing field rather than spill onto neighboring property. All of this can be achieved without increasing pole heights, so luminaires may be aimed so their beams are below the horizontal plane of the luminaires. Thus trees or surrounding buildings can block a direct view of the luminaires and neighbors will not experience the direct glare which is endemic in situations where tall poles are used to reduce spill light. This is what limits the resultant spill light and any glare seen by neighbors.

Some people will be concerned that since the lighting system does not direct light up into the sky, fly balls will not be able to be seen. This is not the case since the ground reflects about 10% of the light it receives up into the sky. The players do not have disability glare in their field of vision and therefore the large playing field which reflects light up into the sky produces adequate illumination to allow a player to see and follow the flight of a ball. Proof of this is the ability of a motorist to drive at night and see the surroundings by the light from the headlights except when an approaching car operates its high beams that directs light into the motorist's eyes which causes temporary blinding. The low beam headlight illumination reflects off the ground which provides adequate illumination to see objects that do not receive direct illumination from the headlight. And the illumination values at heights of 40, 60 and 80 feet in FIGS. 14, 15, 16, and 17 identify that there is adequate light to see fly balls for these LED luminaire examples.

The present metal halide luminaires which are designated as providing "full cutoff" provide the ability to limit spill light and glare by having an asymmetric beam pattern that require visors, baffles, and/or lamp shields. They have reduced beam efficiency when compared to luminaires without visors, baffles, and lamp shields. Such "full cutoff" luminaires do not direct light above the horizontal. Such lighting installations must also rely on the reflection of light off the ground to illuminate balls that are hit or thrown above the luminaires. There are many "full cutoff" sports lighting installations that are judged successful in achieving both spill light and glare control as well as meeting the needs of players to follow the flight of fly balls. Their limitation is that they cannot provide modeling since each luminaire primarily only illuminates the area in front of it. To confirm that the present invention provides the required illumination by ground reflection for players to see fly balls, a soccer field (FIG. 10), a football field (FIG. 11), a baseball field (FIG. 12) and a pair of tennis courts (FIG. 13) were illuminated using an LEDs assembly of the present invention. Calculations of the reflected light at heights of 40, 60, and 80 feet for these proposed LED lighting installations are shown in FIGS. 14, 15, 16, and 17. These figures provide values of illumination which are adequate to see fly balls at several locations and at heights of 40, 60, and 80 feet above the illuminated sports playing area for a ground surface reflection of 10%.

Figure 11:
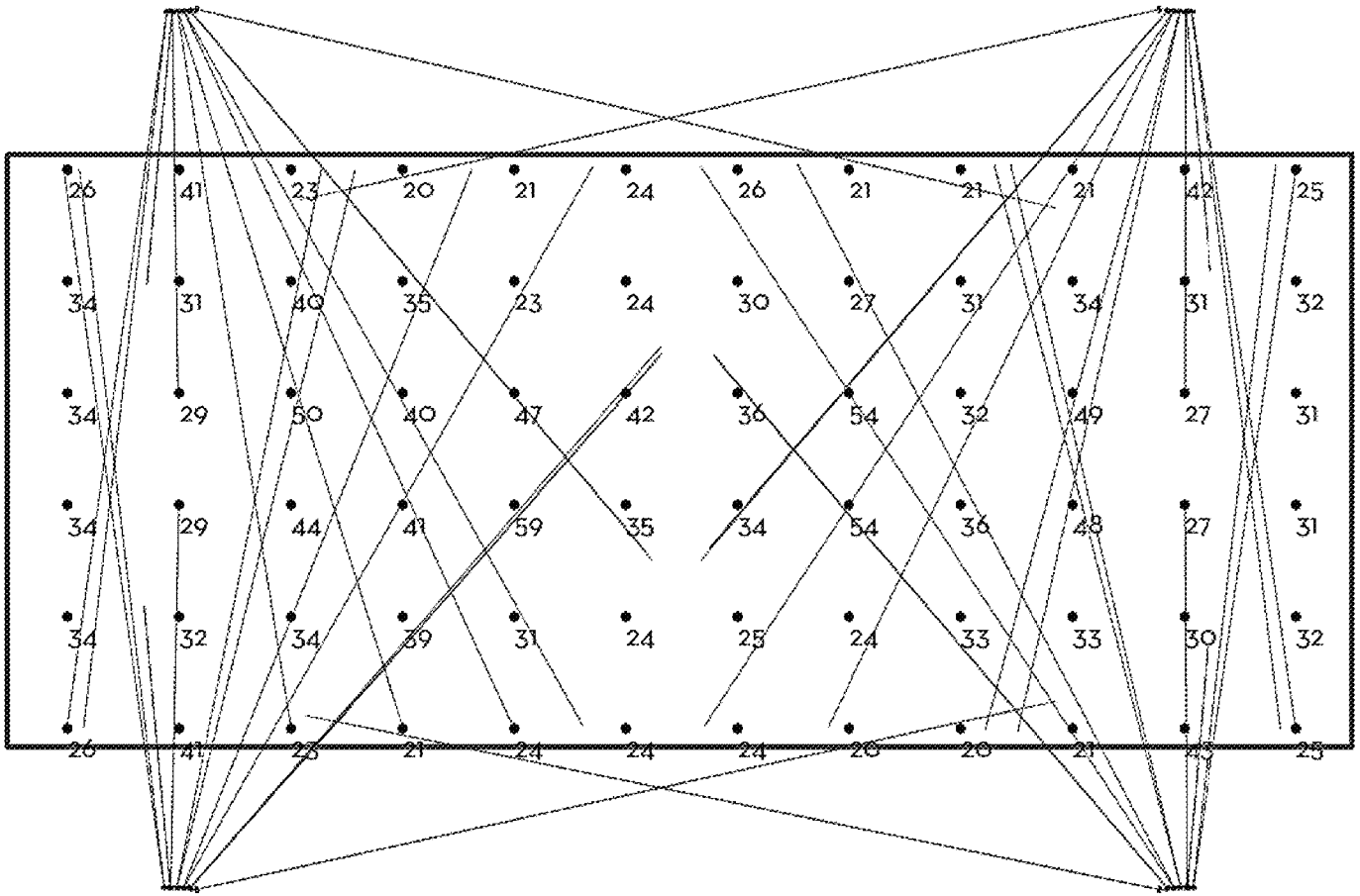
FIG. 11 is a schematic of a football field showing an exemplary installation an LED luminaire assembly of the present invention in which horizontal illuminance values are shown for each calculation point.
Figure 12:
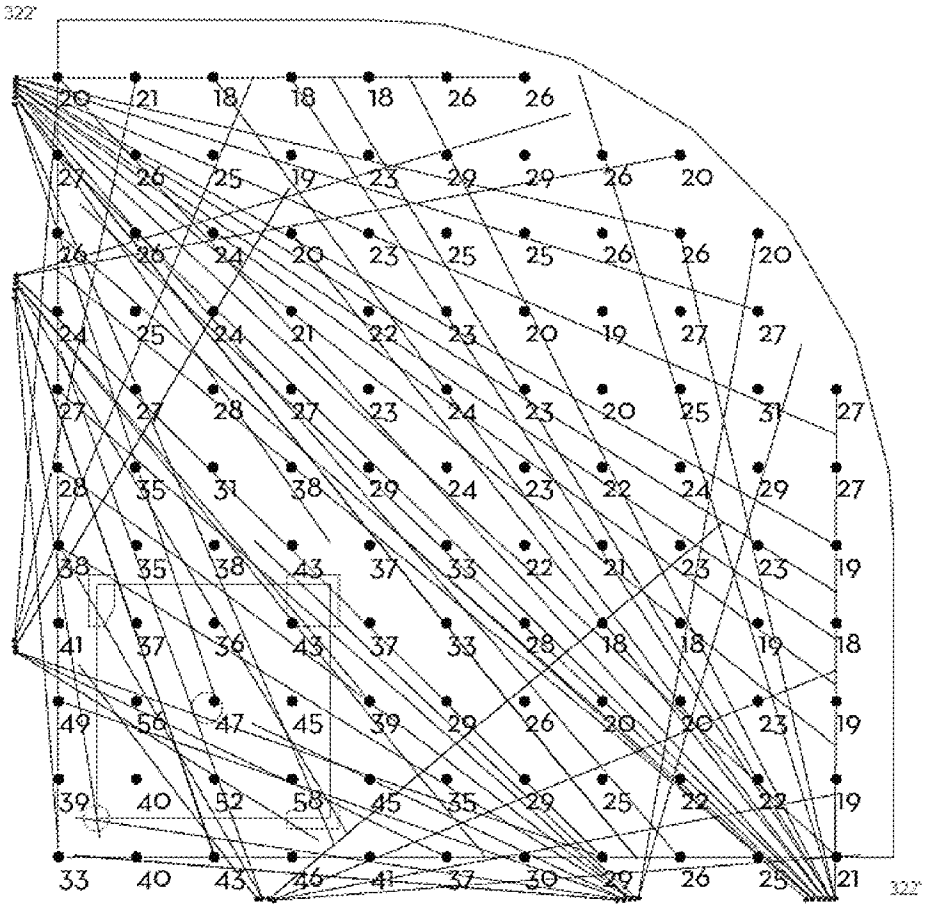
FIG. 12 is a schematic of a baseball field showing an exemplary installation of an LED luminaire assembly of the present invention in which horizontal illuminance values are shown for each calculation point. The baseball field has 90' between bases and the data shown in the figure is on 30' centers.
Figure 13:
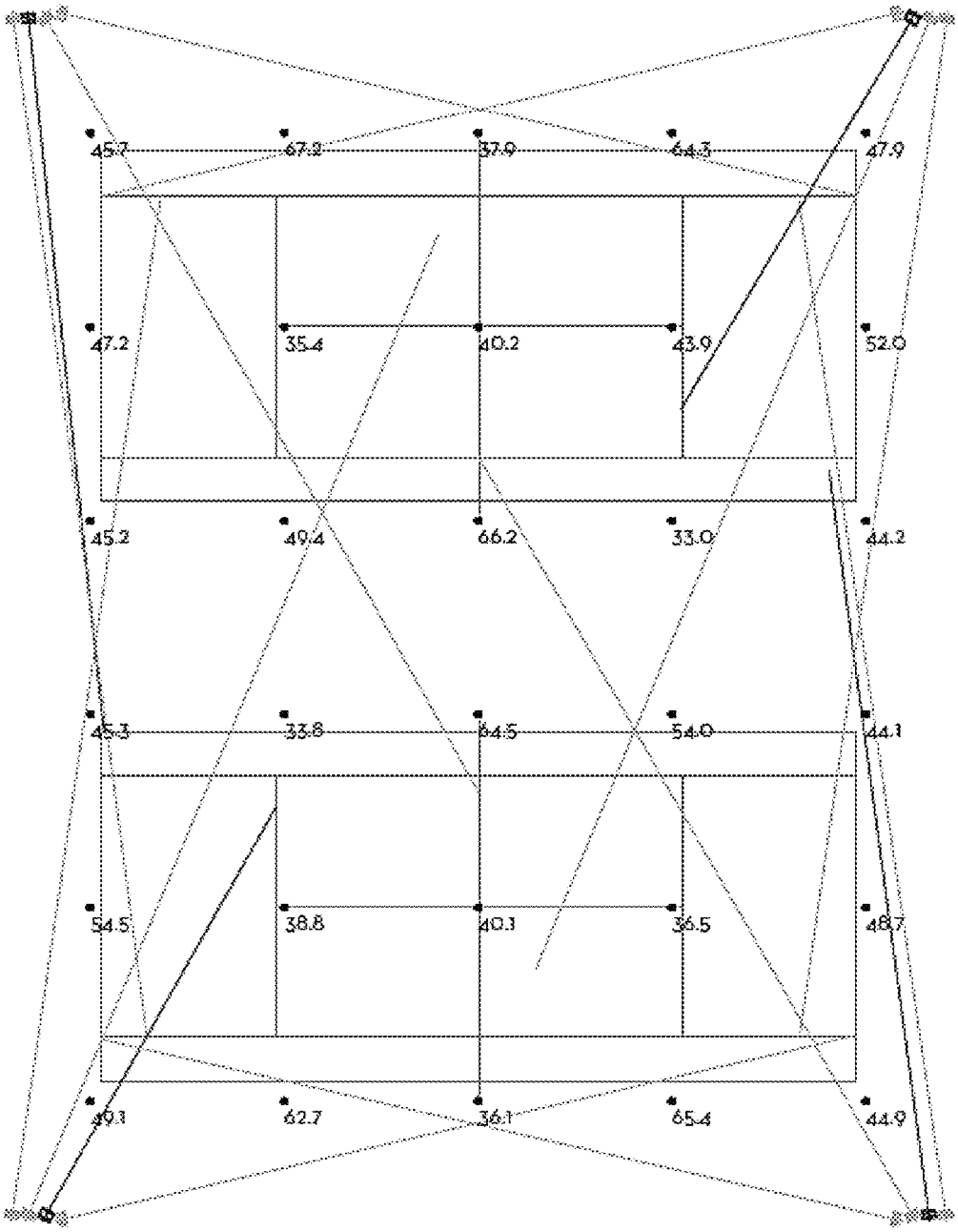
FIG. 13 is a schematic of a pair of tennis courts showing an exemplary installation of an LED luminaire assembly of the present invention in which horizontal illuminance values are shown for each calculation point.

Embodiments of typical lighting installations using a luminaire assembly of the present invention are shown in FIG. 10 (soccer), FIG. 11 (football), FIG. 12 (baseball), and FIG. 13 (tennis) where they identify the luminaire beam type, aiming, quantity, location; pole height; average light level; uniformity; and utilance, lamp data. With LED luminaires that use LEDs that provide over 150 lpw, these assemblies would reduce the present metal halide comparable lighting system's wattage by about 50%. With this energy savings, the life cycle cost of these LED luminaires will be comparable to the present cost of a metal halide lighting system. With 300 lpw LEDs, the resultant luminaire assembly of the present invention can have a 25% to 40% reduction in its cost versus the present metal halide sports lighting system. Since LEDs can be dimmed, it will be easy to design a control system that provides a specific light level over the useful life of the LED lamps which will probably provide 25 years of service. Since LEDs are available with a daylight color, there will be no color difference when the sport activity starts in daylight and continues into the night. In indoor applications and especially at a 30 footcandle light level, the warmer LED lamps can be used in the luminaires to meet a probable desire for a warm atmosphere. The LED is an instant on, instant off light source, which will eliminate the waiting period for metal halide lamps to start and restart as well as allow sports venues to be on only when they are in use. All of these attributes provide many advantages for LED lighting systems over the present metal halide sports lighting systems.

Figure 18:
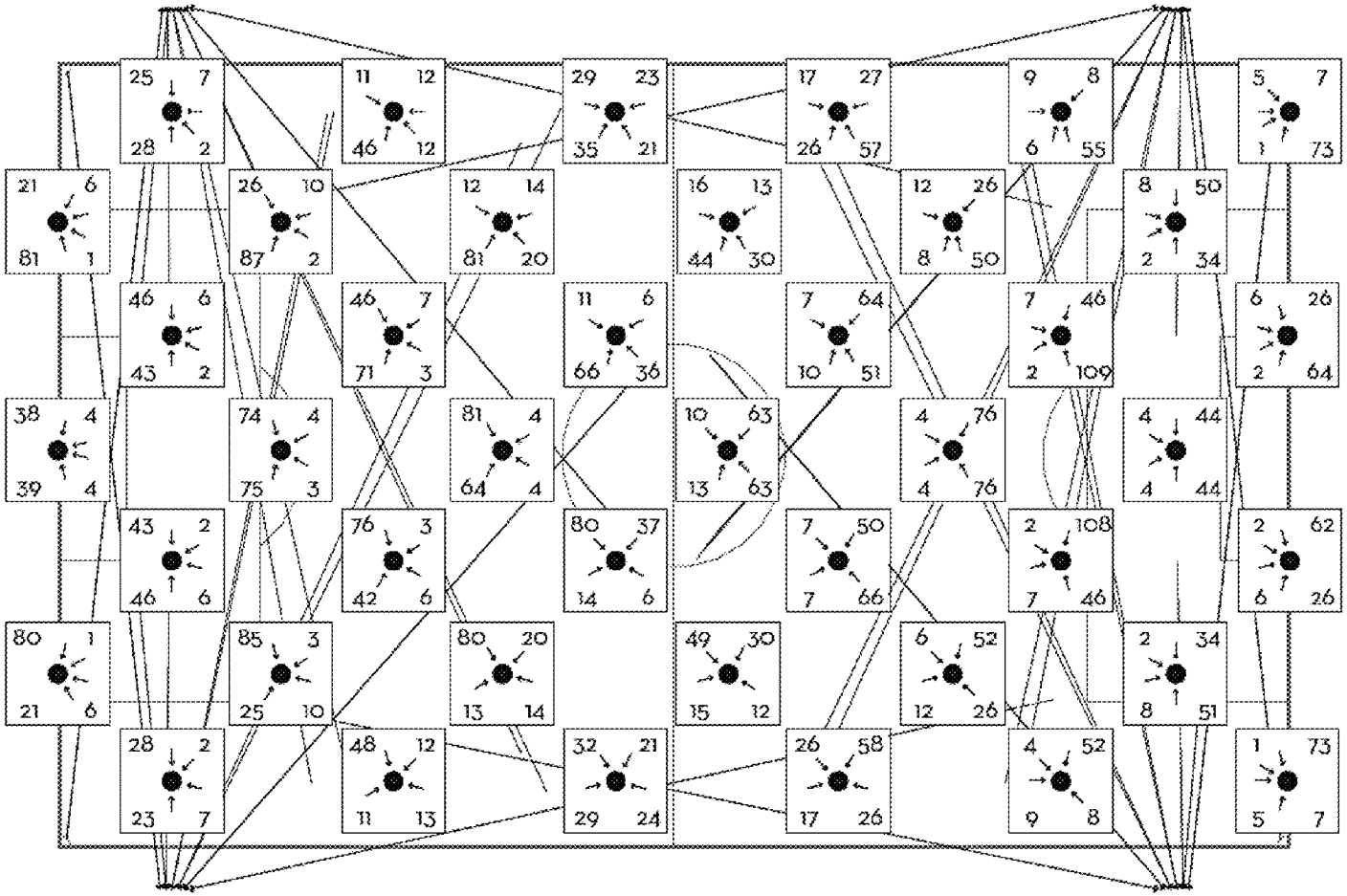
FIG. 18 is a schematic of a soccer field having an LED luminaire assembly of the present invention and showing (using arrows) illuminances in the form of directional vertical footcandle values at the calculation points.
Figure 19:
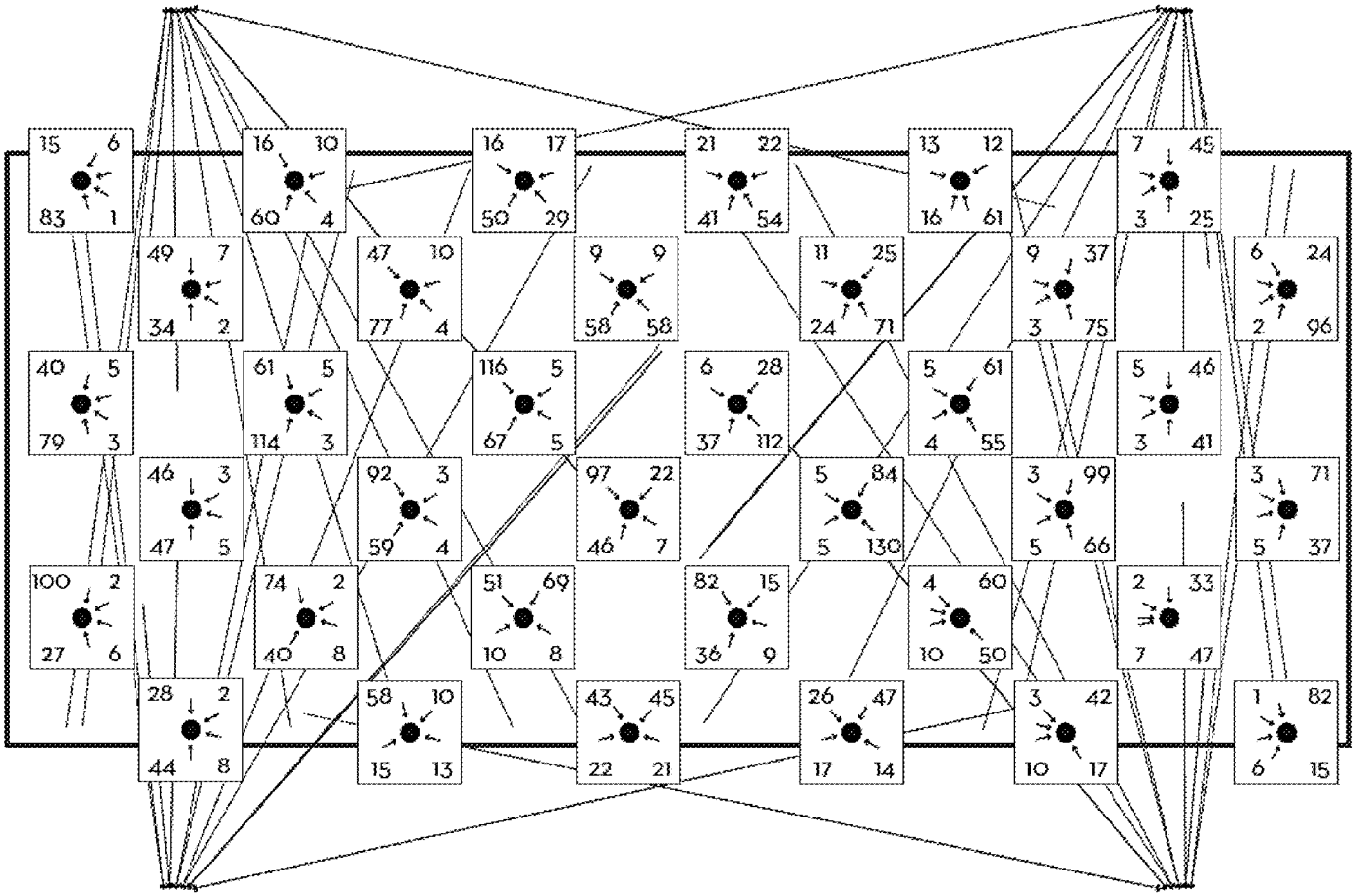
FIG. 19 is a schematic of a football field having an LED luminaire assembly of the present invention and showing (using arrows) illuminances in the form of directional vertical footcandle values at the calculation points.
Figure 20:
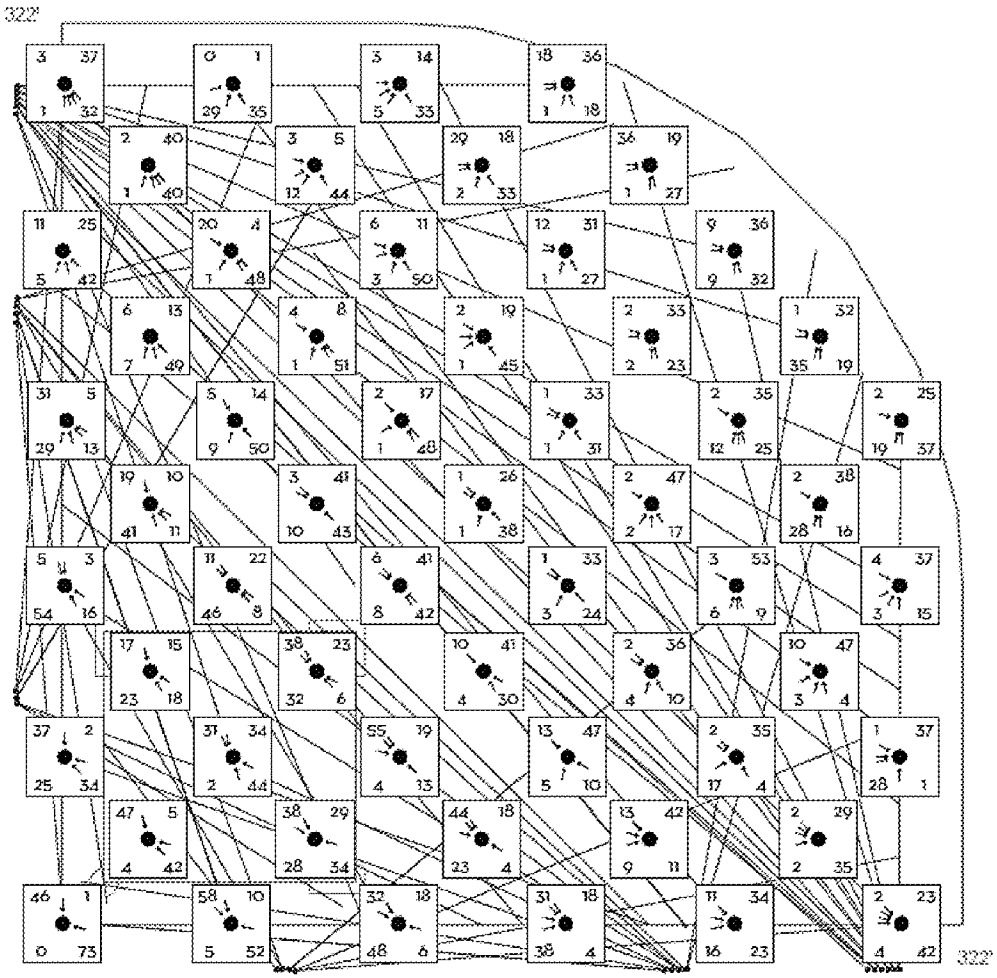
FIG. 20 is a schematic of a baseball field having an LED luminaire assembly of the present invention and showing (using arrows) illuminances in the form of directional vertical footcandle values at the calculation points. The baseball field has 90' between bases.
Figure 21:
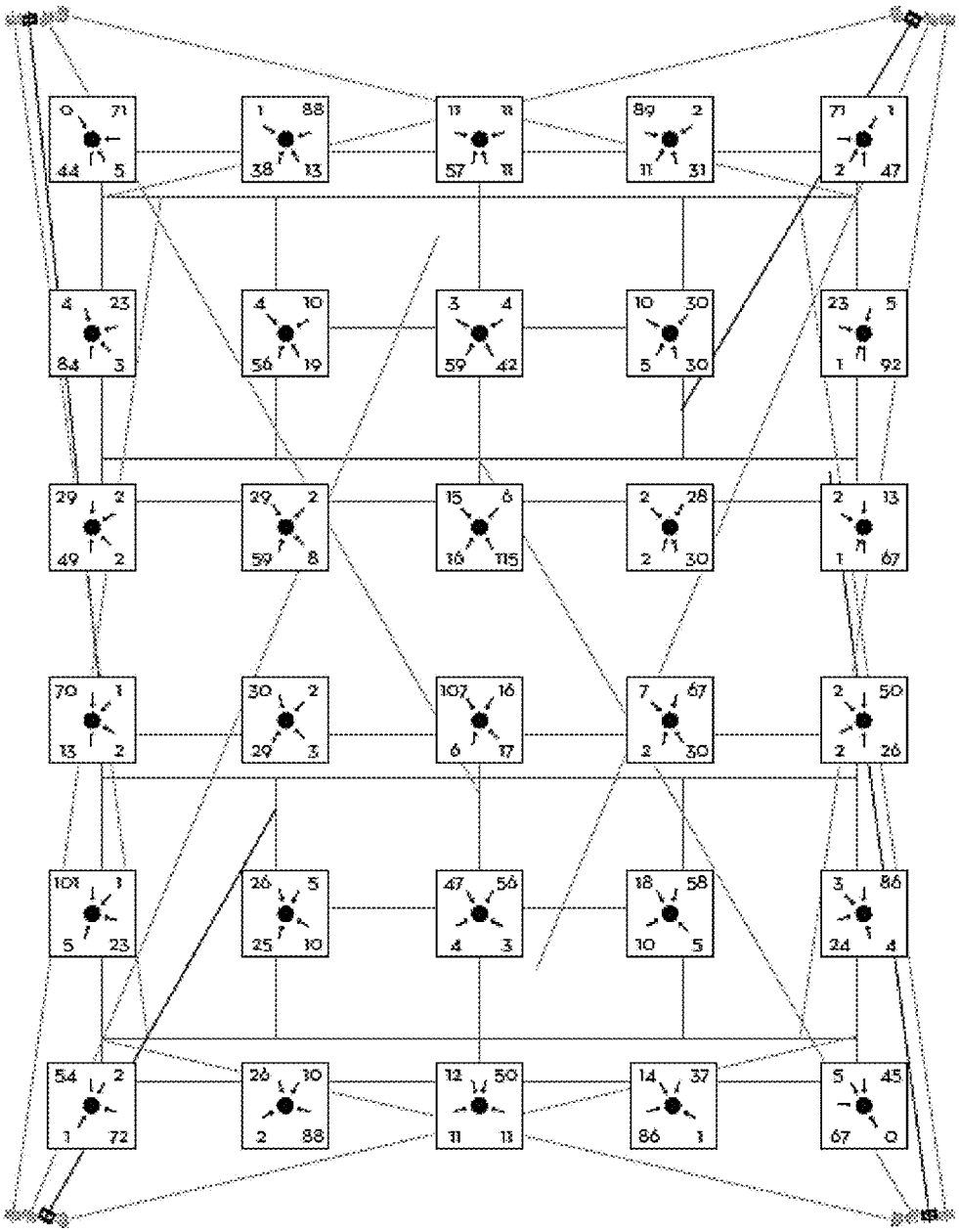
FIG. 21 is a schematic of a pair of tennis courts having an LED luminaire assembly of the present invention and showing (using arrows) illuminances in the form of directional vertical footcandle values at the calculation points.

To identify how modelling is provided by the LED luminaires, the directional vertical footcandle values at the normal calculation points are provided for the four typical applications in FIG. 18 (soccer), FIG. 19 (football), FIG. 20 (baseball), and FIG. 21 (tennis). The locations where the numbers identify that modeling is provided are highlighted. As you can see the direction for each value comes from one of the pole locations which provides a basis to make calculations when evaluating an assembly made by another person which may not have used modelling as the desired result. If an assembly does not achieve modelling because light comes from too many directions resulting in flat illumination, this can be corrected by reducing the number of aiming directions to four by eliminating luminaires from unwanted directions and adding luminaires where key and/or back light is desired. If desired, higher light levels are obtained by adding two-thirds more luminaires to a 30 footcandle lighting design to obtain 50 footcandles or adding one and a third more luminaires to a 30 footcandle design to obtain 70 footcandles, etc. The installation examples show herein are considered hard examples to design since these use few LED luminaires to obtain 30 footcandles. However, these can then be the basis for higher light level assemblies.

In accordance with the detailed explanations provided above, some of the structural aspects via which some of the embodiments of the present invention achieve their advantages include utilization of LED light sources; utilization of NEMA Type 0 beams; locating poles at lower heights (e.g., below surrounding trees, buildings, and/or walls); placing poles at different locations (e.g., for football, closer to the center of the long edge as opposed to being diagonally far from each corner; for soccer, being closer to the edge of the long edge as opposed to being closer to the center of the long edge; for baseball, being relatively away from the home plate and closer to the fence; for tennis, being relatively away from each corner); configuring beams so that they cross with each other more; configuring beams so that they reach longer distances (e.g., close to the opposing side); configuring beams so that they reach the front of spectators; configuring beams so that they cross even in the immediate vicinity of the edges and corners of a playing area.

This application relates to U.S. Pat. No. 4,864,476, titled "Outdoor Lighting System", issued on Sep. 5, 1989, by Thomas M. Lemons and Kenneth M. Spink, and to U.S. Pat. No. 5,313,379, titled "Asymmetric Sport Lighting Luminaire", issued on May 17, 1994, by Thomas M. Lemons and Kenneth M. Spink. The entire teachings of all the references, patents, and/or patent applications cited herein are incorporated by reference in their entirety.

EXEMPLIFICATION

Four different LED luminaire assemblies were created for four types of sports venues—soccer field, football field, baseball field, and a pair of tennis courts. Different results for these are illustrated in FIGS. 10 through 21. In each figure, a standard playing area is demarcated with lines enclosing its area (along with any lines that denote its internal common features) in a rectangular (e.g., for football, soccer, and tennis) or other shape (e.g., a relatively quarter-circle shape depicting a baseball diamond). Pole locations are depicted with dots (from which beams are shown to emanate) around the exterior of the playing area (e.g., close to the corners). Beams are shown to start from the poles (where luminaires are located) and they travel toward inside the playing field. Even though the figures, due to being two-dimensional, do not show the beams being directed up or down, for these examples, all beams were directed below the horizontal plane of the luminaires. Numerical values in the figures are the illuminance readings as further detailed below for each figure.

FIG. 10 shows horizontal illuminance values for a soccer field having a playing area of 210' by 360', and a grid size of 30' by 30'. The pole height is 40'. Additional details and calculation results for this assembly are as follows:

TABLE 6

| Quantity | Label | Description | Lum. Lumens | Lum. Watts |
|---|---|---|---|---|
| 32 | NEMA 0 | Spot Light 9° | 77,244 | 930 |
| 8 | NEMA 2 | Spot Light 20° Lens | 69,062 | 930 |
| 8 | NEMA 3 | Spot Light 40° Lens | 68,306 | 930 |

As seen, this assembly has 48 total luminaires.

TABLE 7

| Label | Units | Avg | Max | Min | Max/Min | # Pts |
|---|---|---|---|---|---|---|
| Horizontal Illuminance | Fc | 28.08 | 44 | 17 | 2.59 | 84 |

This assembly achieves a total utilance, lamp of 59%.

Similarly, FIG. 11 shows horizontal illuminance values for a football field having a playing area of 180' by 360' and a grid size of 30' by 30'. The pole height is 40'. Additional details and calculation results for this assembly are as follows:

TABLE 8

| Quantity | Label | Description | Lum. Lumens | Lum. Watts |
|---|---|---|---|---|
| 33 | NEMA 0 | Spot Light 9° | 77,244 | 930 |
| 8 | NEMA 2 | Spot Light 20° Lens | 69,062 | 930 |
| 8 | NEMA 3 | Spot Light 40° Lens | 68,306 | 930 |

As seen, this assembly has 49 total luminaires.

TABLE 9

| Label | Units | Avg | Max | Min | Max/Min | # Pts |
|---|---|---|---|---|---|---|
| Horizontal Illuminance | Fc | 32.07 | 59 | 20 | 2.95 | 72 |

This assembly achieves a total utilance, lamp of 57%.

Similarly, FIG. 12 shows horizontal illuminance values for a baseball field having an infield area of 22,500 $ft^2$ and an outfield area of 79,200 $ft^2$. The poles have a height of 86'. Various assembly details and calculation results for this assembly are as follows:

TABLE 10

| Quantity | Label | Description | Lum. Lumens | Lum. Watts |
|---|---|---|---|---|
| 63 | NEMA 0 | Spot Light 9° | 77,244 | 930 |
| 2 | NEMA 3 | Spot Light 40° Lens | 68,306 | 930 |

As seen, this assembly has 65 total luminaires.

TABLE 11

| Label | Units | Avg | Max | Min | Max/Min | # Pts |
|---|---|---|---|---|---|---|
| Horizontal Illuminance InField | Fc | 42.32 | 58 | 33 | 1.76 | 25 |
| Horizontal Illuminance OutField | Fc | 24.64 | 38 | 18 | 2.11 | 88 |

This assembly achieves a total utilance, lamp of 58%.

Similarly, FIG. 13 shows horizontal illuminance values for a pair of tennis courts. Various assembly details and calculation results for this assembly are as follows:

TABLE 12

| Quantity | Label | Description | Lum. Lumens | Lum. Watts |
|---|---|---|---|---|
| 12 | NEMA 0 | Spot Light 9° | 57,933 | 698 |
| 4 | NEMA 1 | Spot Light 10° Lens | 17,592 | 232 |

As seen, this assembly has 16 total luminaires.

TABLE 13

| Label | Units | Avg | Max | Min | Max/Min | # Pts |
|---|---|---|---|---|---|---|
| Horizontal Illuminance | Fc | 47.94 | 67.2 | 33.0 | 2.04 | 30 |

This assembly achieves a total utilance, lamp of 75%.

The above four figures, FIG. 10 through FIG. 13 demonstrate the distribution of light on the playing field, the uniformity achieved, and also the high utilization factors obtained with these particular embodiments of the present invention.

Another set of four figures, FIG. 14 through FIG. 17, demonstrate that reflected light from the ground is sufficient to illuminate the filed at heights above the ground (for example to be able to see fly balls).

Figure 14:
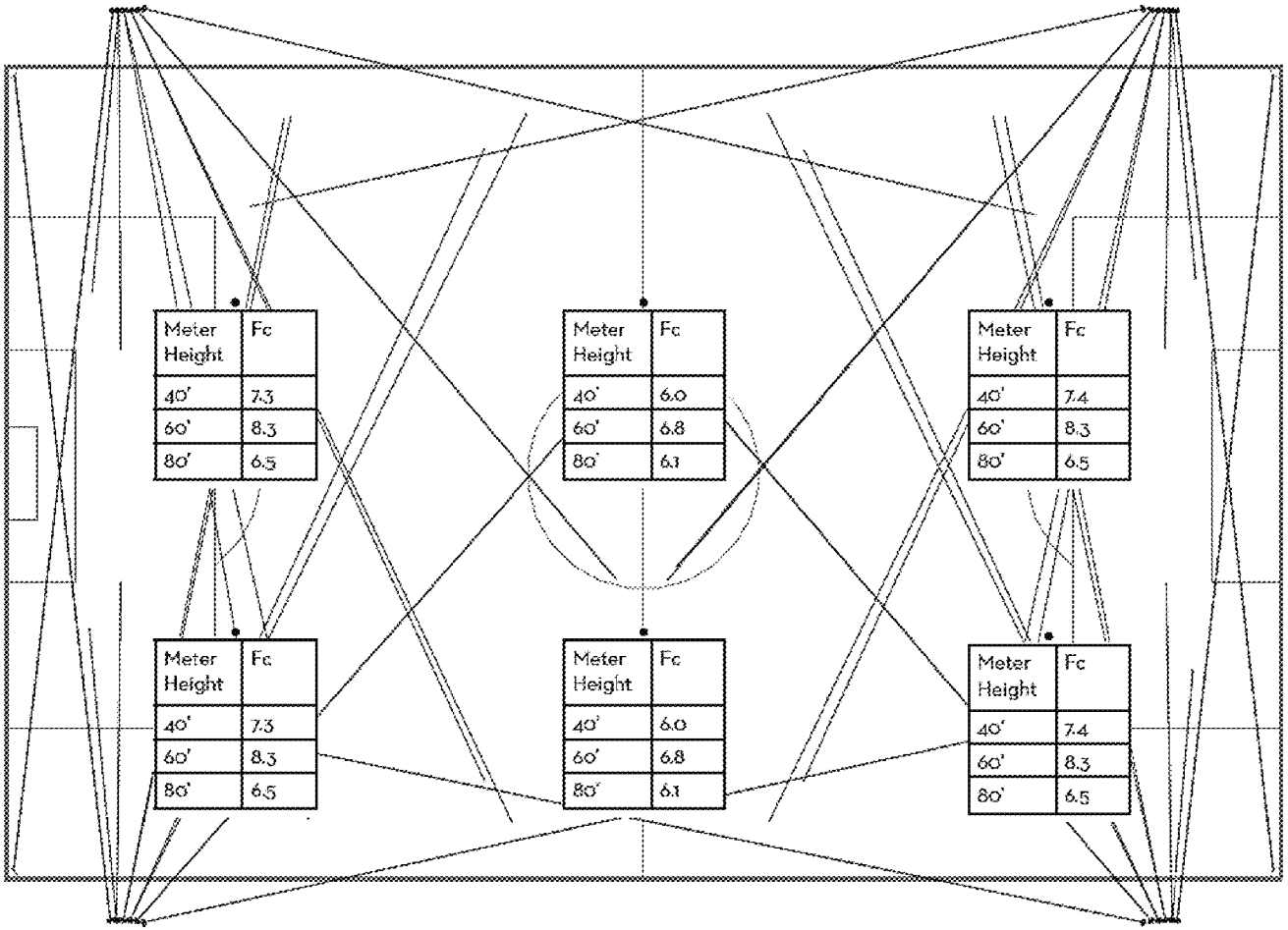
FIG. 14 is a schematic of a soccer field having an LED luminaire assembly of the present invention and showing values of illumination by reflected light at several locations and at heights of 40, 60, and 80 feet above the illuminated sports playing area calculated for a ground surface reflection of 10%.

FIG. 14, for a soccer field, has the same installation as in FIG. 10, with the following additional calculation details:

TABLE 14

| Label | Units | Avg | Max | Min | Max/Min | # Pts |
|---|---|---|---|---|---|---|
| 40' Meter | Fc | 6.67 | 7 | 6 | 1.17 | 6 |
| 60' Meter | Fc | 7.67 | 8 | 7 | 1.14 | 6 |
| 80' Meter | Fc | 6.33 | 7 | 6 | 1.17 | 6 |

Figure 15:
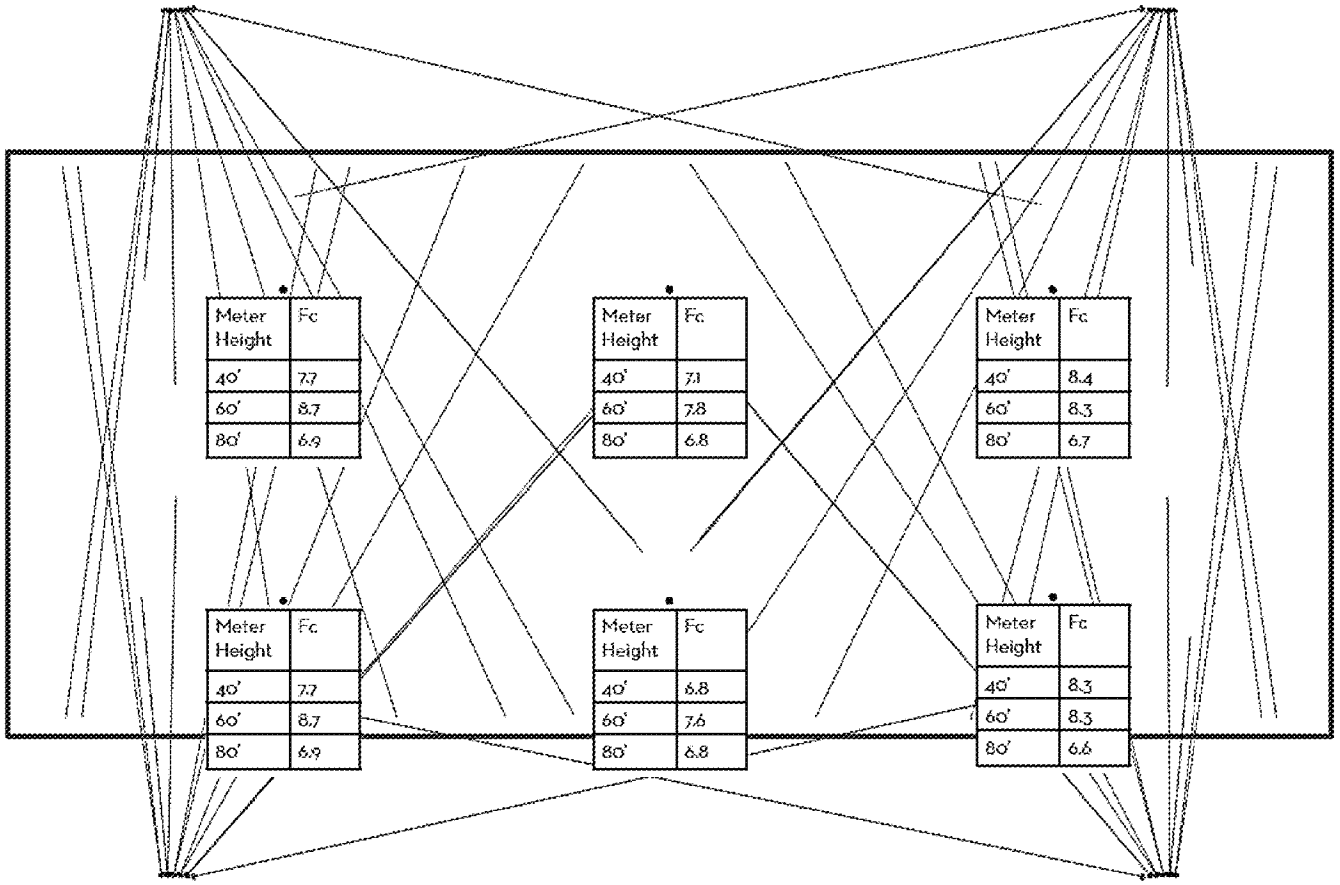
FIG. 15 is a schematic of a football field having an LED luminaire assembly of the present invention and showing values of illumination by reflected light at several locations and at heights of 40, 60, and 80 feet above the illuminated sports playing area calculated for a ground surface reflection of 10%.

Similarly, FIG. 15, for a football field, has the same installation as in FIG. 11, with the following additional calculation details:

TABLE 15

| Label | Units | Avg | Max | Min | Max/Min | # Pts |
|---|---|---|---|---|---|---|
| 40' Meter | Fc | 7.33 | 8 | 7 | 1.14 | 6 |
| 60' Meter | Fc | 8.33 | 9 | 8 | 1.13 | 6 |
| 80' Meter | Fc | 7.00 | 7 | 7 | 1.00 | 6 |

Figure 16:
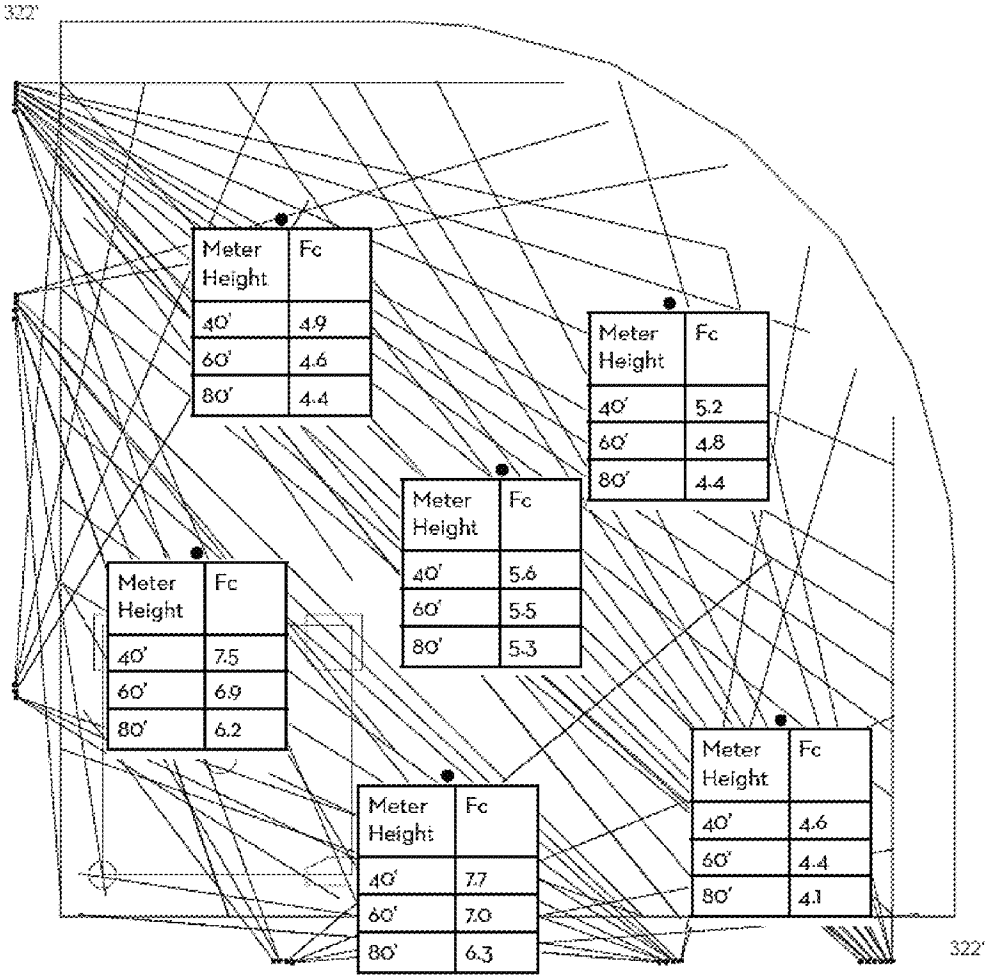
FIG. 16 is a schematic of a baseball field having an LED luminaire assembly of the present invention and showing values of illumination by reflected light at several locations and at heights of 40, 60, and 80 feet above the illuminated sports playing area calculated for a ground surface reflection of 10%. The baseball field has 90' between bases.

Similarly, FIG. 16, for a baseball field, has the same installation as in FIG. 12, with the following additional calculation details:

TABLE 16

| Label | Units | Avg | Max | Min | Max/Min | # Pts |
|---|---|---|---|---|---|---|
| 40' Meter | Fc | 5.92 | 7.7 | 4.6 | 1.67 | 6 |
| 60' Meter | Fc | 5.53 | 7.0 | 4.4 | 1.59 | 6 |
| 80' Meter | Fc | 5.12 | 6.3 | 4.1 | 1.54 | 6 |

Figure 17:
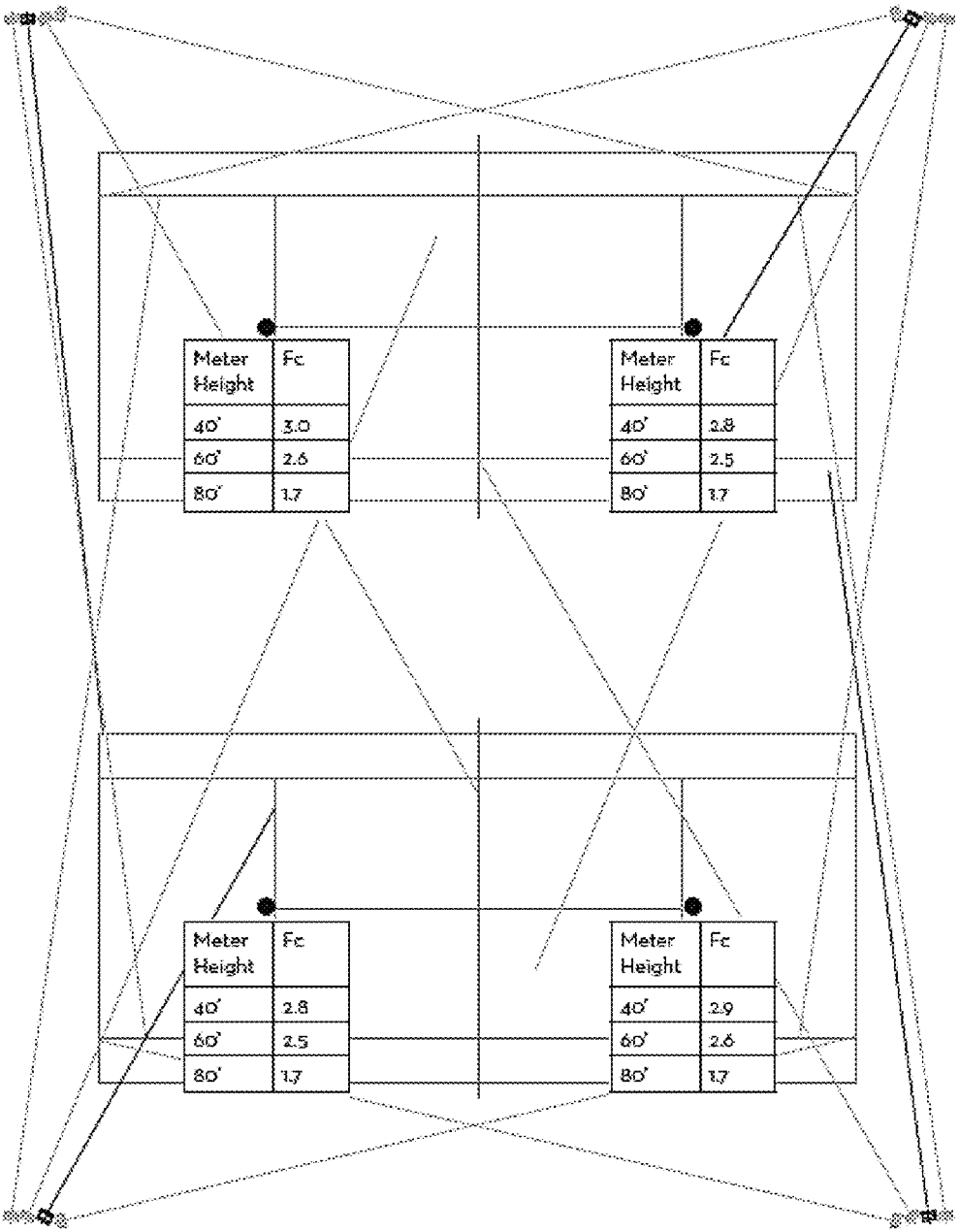
FIG. 17 is a schematic of a pair of tennis courts having an LED luminaire assembly of the present invention and showing values of illumination by reflected light at several locations and at heights of 40, 60, and 80 feet above the illuminated sports playing area calculated for a ground surface reflection of 10%.

Similarly, FIG. 17, for a pair of tennis courts, has the same installation as in FIG. 13, with the following additional calculation details:

TABLE 17

| Label | Units | Avg | Max | Min | Max/Min | # Pts |
|---|---|---|---|---|---|---|
| 40' Meter | Fc | 3.00 | 3.0 | 3.0 | 1.00 | 4 |
| 60' Meter | Fc | 2.60 | 2.6 | 2.6 | 1.00 | 4 |
| 80' Meter | Fc | 1.80 | 1.8 | 1.8 | 1.00 | 4 |

Another set of four figures, FIG. 18 through FIG. 21, demonstrate modeling across the playing area by showing values of vertical illuminance from different directions.

FIG. 18 shows efficient modeling of the full area of a soccer field. This installation uses the same assembly as in FIG. 10. As seen, beams emanating from sources at each pole location are able to provide a sufficient level of illuminance to a substantial number of points, which effectively result in modeling at these points of the playing area. This assembly achieves a total utilance, lamp of 59%.

FIG. 19 shows efficient modeling of the full area of a football field. This installation uses the same assembly as in FIG. 11. As seen, beams emanating from sources at each pole location are able to provide a sufficient level of illuminance to a substantial number of points, which effectively result in modeling at these points of the playing area. This assembly achieves a total utilance, lamp of 57%.

FIG. 20 shows efficient modeling of the full area of a baseball field. This installation uses the same assembly as in FIG. 12. As seen, beams emanating from sources at each pole location are able to provide a sufficient level of illuminance to a substantial number of points, which effectively result in modeling at these points of the playing area. This assembly achieves a total utilance, lamp of 58%.

FIG. 21 shows efficient modeling of the full area of a pair of tennis courts. This installation uses the same assembly as in FIG. 13. As seen, beams emanating from sources at each pole location are able to provide a sufficient level of illuminance to a substantial number of points, which effectively result in modeling at these points of the playing area. This assembly achieves a total utilance, lamp of 75%.

The above calculations were obtained using standard photometric lighting calculation software referred to as AGi32 Software from Lighting Analyst (Littleton, Colo.). This program uses the photometric performance data for the various LED luminaires that are contained in what is known as IES Electronic Transfer Files, which are available from luminaire manufacturers and reported in accordance with the ANSI/IES Standard LM-63-02, *Standard File Format for the Electronic Transfer of Photometric Data and Related Information*. The luminaires chosen as the NEMA type 0, 1, 2, 3 and 4 units used in these applications are products from several manufacturers chosen for their ability to meet the specific beam spread, beam intensity, and efficiency needed to provide the qualities of light dictated in this specification to best illuminate sport venues.

The relevant teachings of all the references, patents and/or patent applications cited herein are incorporated herein by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. An assembly of LED luminaires for illuminating a sports venue, the sports venue having a defined playing area, the assembly of LED luminaires comprising:

a. a plurality of LED light sources forming arrays of LED light sources, wherein the LED light sources are distributed at the sports venue and directed at the playing area, wherein the arrays of LED light sources are contained in luminaires that, for a viewing direction, produce key light, back light, or fill light, and wherein, when no back light is produced, a luminous flux provided by the luminaires that produce fill light is less than or equal to about 60% of a luminous flux provided by the luminaires that produce key light, and when both key light and back light are produced, a luminous flux provided by the luminaires that produce fill light is also less than or equal to about 40% of a combined luminous flux provided by the luminaires that produce key light and the luminaires that produce back light;

b. a plurality of optics mounted relative to the arrays of LED light sources, each optic adapted to control one or more light sources to produce one or more beam types to illuminate the playing area, wherein the beam types are selected from the group consisting of NEMA Types 0, 1, 2, 3, 4, and 5; and c. a plurality of mounts to position the light sources and the optics, wherein the mounts allow the light sources to direct light to the playing area;

wherein distribution of the luminaires provides modeling for at least a portion of the playing area.

2. The assembly of LED luminaires for illuminating a sports venue of claim 1, wherein at least 50% of the beam types of 1b comprise NEMA type 0.

3. The assembly of LED luminaires for illuminating a sports venue of claim 1, wherein the assembly of luminaires has a utilance, lamp ($U_l$) greater than 50%.

4. The assembly of LED luminaires for illuminating a sports venue of claim 1, wherein distribution of the luminaires that produce the key light, the back light, and the fill light provides modeling for the playing area, and wherein the modeled playing area is between about 60% and about 100% of the playing area.

5. The assembly of LED luminaires for illuminating a sports venue of claim 1, wherein the luminaires are directed onto the playing area in one or more directions that are greater than 40° off the axis of a primary viewing direction of players.

6. The assembly of LED luminaires for illuminating a sports venue of claim 1, wherein the luminaires are directed onto the playing area in directions that limit glare from a normal viewing directions of spectators.

7. The assembly of LED luminaires for illuminating a sports venue of claim 1, wherein the luminaires are substantially directed at each portion of the playing area from three or four different directions.

8. The assembly of LED luminaires for illuminating a sports venue of claim 1, wherein a resultant illumination limits spill light and glare to meet industry established requirements for neighbors located around the sports venue.

9. The assembly of LED luminaires for illuminating a sports venue of claim 1, wherein none of the luminaires are directed above the horizontal in order to limit sky glow, and wherein reflection of light upward from a ground provides a required illumination for players to see and follow fly balls.

10. The assembly of LED luminaires for illuminating a sports venue of claim 1, wherein the beam types that are of NEMA Type 0 have an efficiency that is 90%±4%, and wherein efficiencies of other luminaire beam types are greater than 80%.

11. The assembly of LED luminaires for illuminating a sports venue of claim 1, wherein the sports venue is a football field, soccer field, tennis court, ice hockey rink, basketball court, or baseball field.

12. An assembly of LED luminaires for illuminating a sports venue, the sports venue having a defined playing area, the assembly of LED luminaires comprising:

a. a plurality of LED light sources forming arrays of LED light sources, wherein the LED light sources are distributed at the sports venue and directed at the playing area, wherein the arrays of LED light sources are contained in luminaires that, for a viewing direction, produce key light, back light, or fill light, and wherein, when no back light is produced, a luminous flux provided by the luminaires that produce fill light is less than or equal to about 60% of a luminous flux provided by the luminaires that produce key light, and when both key light and back light are produced, a luminous flux provided by the luminaires that produce fill light is also less than or equal to about 40% of a combined luminous flux provided by the luminaires that produce key light and the luminaires that produce back light;

b. a plurality of optics mounted relative to the arrays of LED light sources, each optic adapted to control one or more light sources to produce one or more beam types to illuminate the playing area, wherein at least 50% of the beam types are NEMA type 0, and the balance of the beam types are selected from the group consisting of NEMA Types 1, 2, 3, 4, and 5; and c. a plurality of mounts to position the light sources and the optics, wherein the mounts allow the light sources to direct light to the playing area;

wherein distribution of the luminaires provides modeling for at least a portion of the playing area, thereby creating a modeled playing area.

13. The assembly of LED luminaires for illuminating a sports venue of claim 12, wherein the assembly of luminaires has a utilance, lamp ($U_l$) greater than 50%.

14. The assembly of LED luminaires for illuminating a sports venue of claim 12, wherein distribution of the luminaires that produce the key light, the back light, and the fill light provides modeling for the playing area, and wherein the modeled playing area is between about 60% and about 100% of the playing area.

15. An assembly of LED luminaires for illuminating a sports venue, the sports venue having a defined playing area, the assembly of LED luminaires comprising:

a. a plurality of LED light sources forming arrays of LED light sources, wherein the LED light sources are distributed at the sports venue and directed at the playing area, wherein the arrays of LED light sources are contained in luminaires that, for a viewing direction, produce key light, back light, or fill light, and wherein, when no back light is produced, a luminous flux provided by the luminaires that produce fill light is less than or equal to about 60% of a luminous flux provided by the luminaires that produce key light, and when both key light and back light are produced, a luminous flux provided by the luminaires that produce fill light is also less than or equal to about 40% of a combined luminous flux provided by the luminaires that produce key light and the luminaires that produce back light;

b. a plurality of optics mounted relative to the arrays of LED light sources, each optic adapted to control one or more light sources to produce one or more beam types to illuminate the playing area; and c. a plurality of mounts to position the light sources and the optics, wherein the mounts allow the light sources to direct light to the playing area;

wherein distribution of the luminaires provides modeling for at least a portion of the playing area, thereby creating a modeled playing area, and wherein the assembly of luminaires has a utilance, lamp ($U_l$) greater than 60%.

16. The assembly of LED luminaires for illuminating a sports venue of claim 15, wherein the beam types are selected from the group consisting of NEMA Types 0, 1, 2, 3, 4, and 5.

17. The assembly of LED luminaires for illuminating a sports venue of claim 16, wherein at least 50% of the beam types are NEMA type 0.

18. An assembly of LED luminaires for illuminating a sports venue, the sports venue having a defined playing area, the assembly of LED luminaires comprising:

a. a plurality of LED light sources forming arrays of LED light sources, wherein the LED light sources are distributed at the sports venue and directed at the playing area, wherein the arrays of LED light sources are contained in luminaires that, for a viewing direction, produce key light, back light, or fill light, and wherein, when no back light is produced, a luminous flux provided by the luminaires that produce fill light is less than or equal to about 60% of a luminous flux provided by the luminaires that produce key light, and when both key light and back light are produced, a luminous flux provided by the luminaires that produce fill light is also less than or equal to about 40% of a combined luminous flux provided by the luminaires that produce key light and the luminaires that produce back light;

b. a plurality of optics mounted relative to the arrays of LED light sources, each optic adapted to control one or more light sources to produce one or more beam types to illuminate the playing area; and c. a plurality of mounts to position the light sources and the optics, wherein the mounts allow the light sources to direct light to the playing area;

wherein distribution of the luminaires provides modeling for at least a portion of the playing area; and wherein the assembly of LED luminaires directs all of the luminaire beams onto the playing area and an immediate area adjacent to the playing area to eliminate spill light.

19. An assembly of LED luminaires for illuminating a sports venue, the sports venue having a defined playing area, the assembly of LED luminaires comprising:

a. a plurality of LED light sources forming arrays of LED light sources, wherein the LED light sources are distributed at the sports venue and directed at the playing area, wherein the arrays of LED light sources are contained in luminaires that, for a viewing direction, produce key light or fill light, and wherein a luminous flux provided by the luminaires that produce fill light is less than or equal to about 60% of a luminous flux provided by the luminaires that produce key light;

b. a plurality of optics mounted relative to the arrays of LED light sources, each optic adapted to control one or more light sources to produce one or more beam types to illuminate the playing area; and c. a plurality of mounts to position the light sources and the optics, wherein the mounts allow the light sources to direct light to the playing area;

wherein distribution of the luminaires provides modeling for at least a portion of the playing area; wherein the modeled playing area is between about 60% to about 100% of the playing area; and wherein at least 50% of the beam types are NEMA type 0.

20. The assembly of LED luminaires for illuminating a sports venue of claim 19, wherein the assembly of luminaires has a utilance, lamp ($U_l$) greater than 50%.

21. An assembly of LED luminaires for illuminating a sports venue, the sports venue having a defined playing area, the assembly of LED luminaires comprising:

a. a plurality of LED light sources forming arrays of LED light sources, wherein the LED light sources are distributed at the sports venue and directed at the playing area, wherein the arrays of LED light sources are contained in luminaires that, for a viewing direction, produce key light, back light, or fill light, and wherein, when both key light and back light are produced, a luminous flux provided by the luminaires that produce fill light is also less than or equal to about 40% of a combined luminous flux provided by the luminaires that produce key light and the luminaires that produce back light;

b. a plurality of optics mounted relative to the arrays of LED light sources, each optic adapted to control one or more light sources to produce one or more beam types to illuminate the playing area; and c. a plurality of mounts to position the light sources and the optics, wherein the mounts allow the light sources to direct light to the playing area;

wherein distribution of the luminaires provides modeling for at least a portion of the playing area; wherein the modeled playing area is between about 60% to about 100% of the playing area; and wherein at least 50% of the beam types are NEMA type 0.

22. The assembly of LED luminaires for illuminating a sports venue of claim 21, wherein the assembly of luminaires has a utilance, lamp ($U_l$) greater than 50%.

* * * * *